US006257701B1

(12) United States Patent
Otani et al.

(10) Patent No.: US 6,257,701 B1
(45) **Date of Patent: *Jul. 10, 2001**

(54) INK JET RECORDING APPARATUS HAVING AN EXCHANGEABLE INK JET HEAD CARTRIDGE MOUNTABLE THEREON AND RECOVERY METHOD OF SAID CARTRIDGE

(75) Inventors: Tsuyoshi Otani, Machida; Yoshiaki Takayanagi; Noribumi Koitabashi, both of Yokohama; Yasuhiro Numata, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/949,528

(22) Filed: Oct. 14, 1997

Related U.S. Application Data

(62) Division of application No. 08/790,112, filed on Jan. 29, 1997, which is a continuation of application No. 08/513,345, filed on Aug. 10, 1995, now abandoned, which is a continuation of application No. 08/015,428, filed on Feb. 9, 1993, now abandoned.

(30) Foreign Application Priority Data

| | | |
|---|---|---|
| Feb. 10, 1992 | (JP) | 4-23674 |
| Apr. 20, 1992 | (JP) | 4-99268 |
| Apr. 20, 1992 | (JP) | 4-99270 |
| Jun. 16, 1992 | (JP) | 4-181799 |

(51) Int. Cl.[7] ..... B41J 2/14
(52) U.S. Cl. ..... 347/49; 247/5
(58) Field of Search ..... 347/49, 108, 5, 347/9, 14, 87, 50, 19; 346/41; 399/13, 24, 25, 88, 90

(56) References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,798,485 | 1/1989 | Onoda et al. | 400/54 |
| 4,951,066 | 8/1990 | Terasawa et al. | 347/33 |
| 4,970,533 | 11/1990 | Saito et al. | 347/86 |
| 5,138,343 | 8/1992 | Aichi et al. | 347/30 |
| 5,166,699 | 11/1992 | Yano et al. | 347/17 |
| 5,172,140 | 12/1992 | Hirabayashi et al. | 347/36 |
| 5,182,582 | 1/1993 | Okamura | 347/33 |
| 5,266,974 | 11/1993 | Koitabashi et al. | 347/33 |
| 5,266,975 | 11/1993 | Mochizuki et al. | 347/23 |
| 5,608,442 * | 3/1997 | Bennefeld et al. | 347/211 |
| 5,625,384 | 4/1997 | Numata et al. | 347/23 |
| 5,638,097 * | 6/1997 | Takayanagi et al. | 347/7 |

FOREIGN PATENT DOCUMENTS

| | | |
|---|---|---|
| A0255687 | 2/1988 | (EP) . |
| 442470A2 | 8/1991 | (EP) . |
| 0495669 | 7/1992 | (EP) . |
| 0551752 | 7/1993 | (EP) . |

(List continued on next page.)

OTHER PUBLICATIONS

An English version of this Patent is enclosed for your reference.*

*Primary Examiner*—N. Le
*Assistant Examiner*—Shih-wen Hsieh
(74) *Attorney, Agent, or Firm*—Fitzpatrick, Cella, Harper & Scinto

(57) ABSTRACT

An ink jet recording apparatus having an ink recording head detachable therefrom, characterized in that power supply device to the ink recording head is shut off when the recording head is detached therefrom.

9 Claims, 20 Drawing Sheets

FOREIGN PATENT DOCUMENTS

| | | | | |
|---|---|---|---|---|
| 54-56847 | | 5/1979 | (JP) . | |
| 59-123670 | | 7/1984 | (JP) . | |
| 59-138461 | | 8/1984 | (JP) . | |
| 60-71260 | | 4/1985 | (JP) . | |
| 62-169669 | | 7/1987 | (JP) . | |
| 63-224960 | | 9/1988 | (JP) . | |
| 1-82962 | | 3/1989 | (JP) . | |
| 3-73352 | | 3/1991 | (JP) . | |
| 3193451 | * | 8/1991 | (JP) . | |
| 3-234541 | | 10/1991 | (JP) . | |
| 4-347655 | | 12/1992 | (JP) . | |
| 4-347654 | * | 12/1992 | (JP) | 347/49 |
| 63-132508 | | 6/1998 | (JP) . | |
| WO90/00304 | | 1/1990 | (WO) . | |

* cited by examiner

FIG. 7A

EEPROM MAPPING

| <ADDRESS> | <BIT NO.> | | HS DATA (6bit)×128 | <BIT NO.> |
|---|---|---|---|---|
| 0 | 7 | (bit1) (bit0) | NOZZLE 0 | 0 |
| | SENS | | | |
| 1 | 15 | (bit3) (bit2) | NOZZLE 1 | 8 |
| 2 | 23 | (bit1) (bit0) | NOZZLE 2 | 16 |
| | T1 | | | |
| 3 | 31 | (bit3) (bit2) | NOZZLE 3 | 24 |
| 4 | 39 | (bit1) (bit0) | NOZZLE 4 | 32 |
| | T2 | | | |
| 5 | 47 | (bit3) (bit2) | NOZZLE 5 | 40 |
| 6 | 55 | bit1 bit0 | NOZZLE 6 | 48 |
| 7 | 63 | bit3 bit2 | | 56 |
| ⋮ | 71 | | | 64 |
| | ID 79 | | | |
| ⋮ | 191 | | | 184 |
| 24 | 199 | bit17 bit16 | | 192 |
| 25 | 207 | bit19 bit18 | NOZZLE 15 | 200 |
| ⋮ | | COLR | NOZZLE 16 | |
| 122 | 983 | | NOZZLE 122 | 976 |
| 123 | 991 | | NOZZLE 123 | 984 |
| 124 | 999 | | NOZZLE 124 | 992 |
| 125 | 1007 | | NOZZLE 125 | 1000 |
| 126 | 1015 | | NOZZLE 126 | 1008 |
| 127 | 1023 | | NOZZLE 127 | 1016 |

FIG. 7B (VARIOUS DATA)

| SYMBOL | NUMBER OF CONSTITUTING BITS | SIGNIFICANCE |
|---|---|---|
| SENS | 4 | PROPERTIES OF SENSOR |
| T1 | 4 | DRIVING PULSE P1 |
| T2 | 4 | DRIVING PULSE P3 |
| ID | 20 | PRODUCTION NUMBER |
| COLR | 2 | COLOR OF INK |

INK JET RECORDING APPARATUS HAVING AN EXCHANGEABLE INK JET HEAD CARTRIDGE MOUNTABLE THEREON AND RECOVERY METHOD OF SAID CARTRIDGE

This application is a division of application Ser. No. 08/790,112, filed Jan. 29, 1997, which was a continuation of application Ser. No. 08/513,345, filed Aug. 10, 1995, now abandoned, which was a continuation of application Ser. No. 08/015,428, filed Feb. 9, 1993, now abandoned.

BACKGROUND OF THE INVENTION

1. Field of the Invention

The present invention relates to an ink jet recording apparatus and a recovery method, and more particularly to an ink jet recording apparatus having an ink jet recording head of the cartridge type detachable from a main body and a recovery method at the exchange of cartridge.

2. Related Background Art

Recording apparatuses having the features of printer, copying machine, facsimile apparatus or the like, or recording apparatuses for use as the output device from a complex electronic equipment or work station including a computer or word processor are constituted to record the image (including characters) onto a recording sheet (recording medium) such as a paper or plastic thin plate, based on the image information (including character information). Depending on the recording method, such recording apparatuses can be classified into the ink jet system, wire dot system, thermal system and laser beam system.

In a recording apparatus of the serial type based on the serial scan method of scanning in a direction transverse to a conveying direction (sub-scan direction) of recording medium, the overall recording is carried out on the recording medium by repeating the operation of recording (or main scanning) the image with recording means mounted on a carriage movable along the recording medium, after setting the recording medium at a predetermined recording position, feeding sheet (or conveying the recording medium) by a predetermined amount after terminating the recording of one line, and then again recording (or main scanning) the image at the next line on the recording medium which is stopped. On the other hand, in a recording apparatus of the line type in which the recording is conducted only by sub-scanning in a conveying direction of recording medium, the overall recording is performed on the recording medium by repeating the operation of setting the recording medium at a predetermined recording position, consecutively recording one line collectively and then feeding sheet (pitch feeding).

Among the above recording apparatuses, a recording apparatus of the ink jet system (an ink jet recording apparatus) is configured to perform the recording on the recording medium by discharging the ink from recording means (recording head) in accordance with an image signal, having the advantages in which recording means can be made compact, high definition image can be recorded at a high speed, the ordinary paper is usable for recording without needs of any special treatment, the running cost is low, there is less noise owing to the non-impact method, and the color image is easily recorded by using color inks. In particular, a line-type recording apparatus using recording means of the full-multi type in which a number of discharge orifices are arranged in a direction of sheet width allows for higher speed recording.

Specifically, recording means (recording head) of the ink jet system of discharging the ink by the use of heat energy can be easily fabricated with an arrangement of liquid channels (discharge orifices) at high density by forming electricity-heat converters, electrodes, liquid channel walls, and a ceiling plate as the film on a substrate through a semiconductor fabrication process such as etching, vapor deposition or sputtering, thereby allowing the recording of high definition image at higher speed in a simple and compact construction. On the other hand, there are a variety of requirements for the material of recording medium, and in recent years, besides a paper or resin thin plate (e.g., OHP) which is an ordinary recording medium, the use of a thin paper or processed paper (punched paper for filing, scored paper, or any shaped paper) has been demanded.

By the way, such an ink jet recording apparatus involves two types in which the ink recording head is exchanged simply by the user and by the service-man at the user's site. The former is usually a cartridge type ink recording head, and the latter is an installed type ink recording head.

In particular, the former ink jet recording apparatus using a cartridge type recording head is noted because it is small and free of maintenance. Such recording head of the cartridge type may contain storage means for storing the control information specific to the head or drive control means for the head.

The ink recording head of the cartridge type exchangeable from the recording apparatus typically comprises a plurality of heat generating elements for the discharge of ink which are arranged simply or as a matrix, wherein the main device powers these heat generating elements at a predetermined drive timing to discharge the ink. However, a recent ink jet recording apparatus for the output of color image has a trend of improving the recording quality by comprising, on the recording head side, but not the main device side, storage means for storing control information for the correction for density unevenness inherent to the recording head, drive pulse information, resist information for the adjustment of recording position, which were not required in the conventional monochrome recording apparatus. In order to transfer a variety of information from the recording apparatus to the main device control unit, a power for the control of the main device (hereinafter denoted as $V_{CC}$) must be also supplied to the recording head.

However, in an apparatus in which the user can simply detach the recording head of the cartridge type, there is a risk that the stored information within the recording head may be destroyed due to reduced reliability of electrical contacts between main device and recording head, the dispersion in positional accuracy, and the contact order between contact points.

If such information is destroyed, the cartridge may become unusable, and in the worst cases, the apparatus itself may be damaged.

On the other hand, in the ink jet recording apparatus, when the ink may not be discharged through certain discharge orifices for a long time depending on recording data, or when the apparatus itself is not used for a long time, the ink within discharge orifices or liquid channels communicating to discharge orifices may be thickened due to evaporation of water content. If the liquid channels are placed in such an unsuitable state for the discharge owing to accumulation of such thickened ink, there is a risk that the discharge quantity of ink may be unstable even if the discharge energy generating elements arranged in liquid channels are driven under certain predefined conditions, resulting in degraded quality of recorded image. Also, a discharge failure may arise due to such thicker ink, or moreover the undischarge may arise due to stiffness of the ink.

Also, in the ink jet recording apparatus, if ink droplets, water droplets, or dirts adhere to the recording head face (discharge orifice formation face) on which ink discharge orifices are provided, there is also a risk that the discharged ink may be pulled off by these adherents, deviating the discharge direction, and reducing the image quality.

To resolve these inconveniences caused by the use of the liquid ink as the recording agent, the ink jet recording apparatus is provided with a specific constitution as not found in other recording apparatuses, that is, a so-called discharge recovery system for the recording head, including means for refreshing the inside of liquid channel and means for rendering the discharge orifice formation face excellent.

For the discharge recovery system, there are various constitutions, wherein means for refreshing the inside of liquid channel is discharging the ink onto a predetermined ink receiving medium by driving discharge energy generating elements (also referred to as preliminary discharge or idle discharge). Also, there is means for compulsorily discharging the ink through discharge orifices by pressurizing the ink supply system or sucking the ink through discharge orifices.

Also, means for preventing the deflection in the discharge direction by refreshing the discharge orifice formation face is cleaning off (wiping) ink droplets and dirts adhering to the periphery of discharge orifices by providing a wiping member which comes into contact with the discharge orifice formation face and behaves in relative movement thereto.

By the way, the head cartridge is packaged and distributed, apart from the recording apparatus main device, and may be stored over a long term. In such a case, when a package is opened and a cartridge is mounted on the main device, it is requisite to securely perform the recording without degradation in image quality.

Thus, when the head cartridge is stored for a very long term, the discharge orifice portion may be closed due to thicker or fixed ink. Also, when the cartridge is removed temporarily and left away for a long time, the discharge orifice portion may be closed.

Even if such a head cartridge is processed through the recovery operation which is normally performed during the recording, all the nozzles may not be completely recovered.

In addition, an ink jet recording apparatus for recording using the cartridge often adopts a constitution of using a common drive source for drive members to accomplish the compactness. In any case, where the drive source for recovery means and that for other drive member are commonly used, if the normal recovery operation is not performed, recording quality may be degraded and the reliability of recording apparatus may be decreased.

SUMMARY OF THE INVENTION

It is a first object of the present invention is to provide an ink jet recording apparatus in which information or control circuit within the head may not be destroyed at the exchange of a head cartridge.

It is a second object of the present invention to provide an ink jet recording apparatus and a recovery method for effecting a secure recovery operation whereby excellent recording after the exchange of head cartridge can be accomplished.

It is a third object of the present invention to provide an ink jet recording apparatus and a recovery method for effecting a reliable and secure recovery operation even if a drive source for recovery operation is used commonly with other drive means.

It is another object of the present invention to provide an ink jet recording apparatus having an ink recording head detachable therefrom, characterized in that power supply means to said ink recording head is shut off when it is detached therefrom.

It is another object of the present invention to provide an ink jet recording apparatus for recording by discharging the ink from a recording head, comprising recovery means for effecting a discharge recovery processing of the recording head, and a control device for controlling the recovery operation with said recovery means, which allows to confirm the print history of said recording head, characterized in that said control device controls said recovery means to effect the discharge recovery operation upon the confirmation of mounting a new head on the ink jet recording apparatus.

It is another object of the present invention to provide an ink jet recording apparatus for recording by discharging the ink from a plurality of recording heads, comprising recovery means for effecting a discharge recovery processing for said plurality of recording heads, consisting of suction means for compulsorily sucking the ink for the discharge, idle discharge drive control means for performing an idle discharge which is not used for the recording, and wiping means for a head face, and a control device for controlling the recovery operation with said recovery means, which allows to confirm each of the print histories from said plurality of recording heads, characterized in that said control device effecting a recovery processing for each recording head in a different combination of each recovery means in accordance with the print history of each recording head, upon the confirmation of mounting a new head on the ink jet recording apparatus.

It is a further object of the present invention to provide a discharge recovery method for an ink jet recording apparatus having first discharge recovery means for compulsorily discharging the ink through discharge orifices of a recording head, and second discharge recovery means for wiping adherents adhering to the periphery of said discharge orifices by moving relatively a discharge orifice formation face of said recording head and an elastic member, characterized by including wiping away said adherents with said second discharge recovery means plural times, after compulsorily discharging the ink with said first discharge recovery means.

It is a still further object of the present invention to provide a recording apparatus for recording onto a recording medium with recording means, characterized in that conveying means for recording medium and other activating means are driven by the same motor, and the supply power to said motor is increased at a predetermined timing when the other activating means is driven.

BRIEF DESCRIPTION OF THE DRAWINGS

FIGS. 7A and 7B are map diagrams for a variety of information within an EEPROM.

FIGS. 16A and 16B show an embodiment of discharge recovery method, wherein FIG. 16A is a view for explaining the state near the discharge orifices before wiping with a rubber blade at the first time, and FIG. 16B is a view for explaining the state near the discharge orifices before wiping with the rubber blade at the second time.

FIGS. 17A and 17B are views for explaining another embodiment of discharge recovery method, wherein FIG. 17A is a perspective view showing the shape of discharge orifice formation face in the ink jet recording apparatus, and FIG. 17B is a side view, partially in cross section, showing the shape of discharge orifice formation face in the ink jet recording apparatus.

FIGS. 18A and 18B show another embodiment of discharge recovery method, wherein FIG. 18A is a view for explaining the state around the periphery of discharge orifice before wiping with a rubber blade at the first time, and FIG. 18B is a view for explaining the state around the periphery of discharge orifice before wiping with the rubber blade at the second time.

FIGS. 19A and 19B show still another embodiment of discharge recovery method, wherein FIG. 19A is a view for explaining the discharge recovery operation for compulsorily discharging the ink using a cap, and FIG. 19B is a view for explaining the discharge recovery operation of wiping with a rubber blade.

DETAILED DESCRIPTION OF THE PREFERRED EMBODIMENTS

Figure 1A:
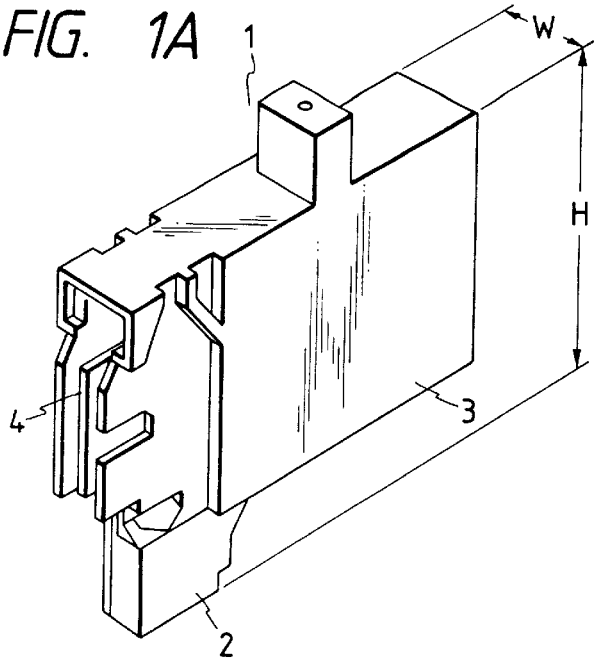
FIGS. 1A and 1B are external views of an ink recording head of the cartridge type.
Figure 1B:
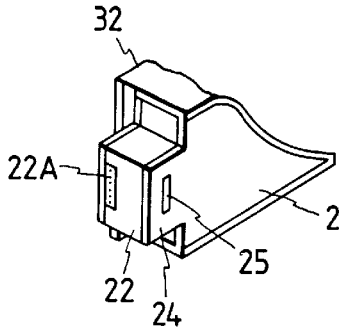
Figure 2:
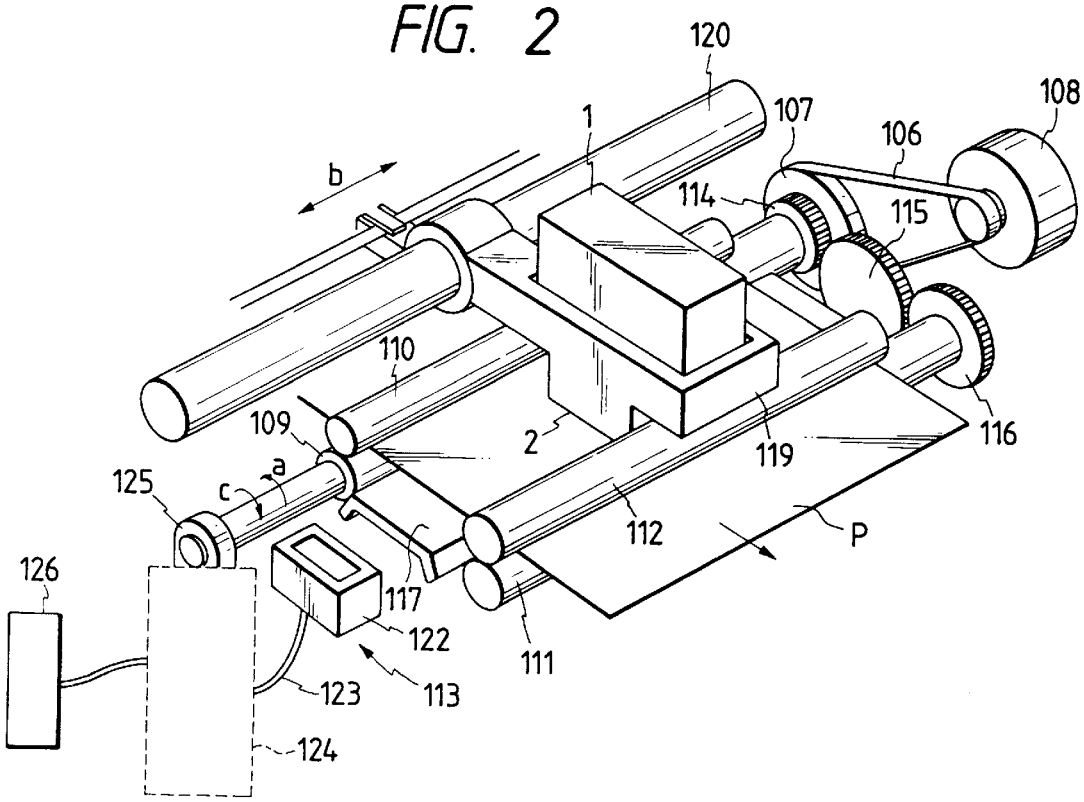
FIG. 2 is an internal mechanical view of an ink jet recording apparatus according to the present invention.

FIGS. 1A and 1B are perspective views showing an embodiment of an ink tank recording chip integrated cartridge for use with an ink jet recording apparatus according to the present invention, and FIG. 2 shows a perspective view of the ink jet recording apparatus with this cartridge 1 mounted thereon.

The apparatus in this embodiment is of a cartridge type in which an ink tank 3 is integrally formed in a recording head 2, whereby the ink impregnated and held in an ink absorbing member (not shown) within the cartridge 1 is supplied to the recording head 2.

Referring now to FIG. 1B, the recording head 2 is comprised of a discharge portion 22 and a supply tank portion 24. The discharge portion 22 has discharge orifices 22A formed on the opposite face to recording medium, liquid channels extending inwardly thereof, recording heaters as the discharge energy generator such as electricity-heat converters arranged in the liquid channels, in an instance of utilizing the heat energy as the discharge energy, for example, and a common liquid chamber communicating to each liquid channel.

Also, the supply tank portion 24 functions as a sub-tank which is supplied with the ink from the ink tank 3 to conduct the ink to the common liquid chamber within the discharge portion 22. The ink absorbing member 32 disposed within the ink tank 3 and having impregnated the ink is made of a porous material or fibers.

FIG. 2 shows schematically an ink jet recording apparatus having the cartridge 1 mounted thereon.

If a sheet supply roller, shown not, is rotated once, a recording medium P is supplied to a conveyance passage. Then, because a conveyance lower roller 109 has been already rotated by a pulse motor (recording medium conveying motor), the leading portion of the recording medium P is carried between the conveyance lower roller 109 and a conveyance upper roller 110 which is driven, and conveyed, so that the amount of feeding sheet P is regulated by a pair of such conveyance rollers 109, 110. Note that the pair of conveyance rollers 109, 110 (conveyance lower roller 109) are rotated via a belt 106 and a pulley 107 by the pulse motor 108.

The recording medium P is further conveyed by the pair of conveyance rollers 109, 110, and stopped temporarily when its leading end portion is inserted between a pair of exhausting rollers 111, 112. The pair of exhausting rollers include a sheet exhausting lower roller 111 and a sheet exhausting upper roller 112 biased against the lower roller by spring means not shown. The sheet exhausting lower roller 111 is rotated via gears 114, 115, 116 by the pulse motor 108 which is common to the conveyance lower roller 109. In this case, the peripheral speed of sheet exhausting roller 111 is set to be higher a predetermined percentage (e.g., 2%) than that of conveyance lower roller 109, so that the recording medium P is retained on a recording plane (which is supported by the platen 117) while being subjected to a predetermined tension.

With the recording medium P positioned and carried on the platen 117 (no sheet feed), one line of recording is carried out in such a way as to move (scan) a carriage 119 along a guide rail 120 in a direction of the arrow b, and drive a recording head 118 mounted on the carriage 119 on the basis of recording information. After terminating one line of recording, the conveyance roller 109 is rotated by a predetermined amount in a direction of the arrow c to feed (sub-scan) recording medium P by one line, so that the recording for the next line is performed. In this way, by repeating alternately the operation of feeding (sub-scanning) recording sheet P and the recording operation carried out in synchronism with the movement (scanning) of the carriage 119, the overall recording for the recording medium P is conducted. The recording medium P after recording is exhausted on to a sheet exhausting tray not shown by the pair of sheet exhausting rollers 111, 112. Thus, a series of recording operation is achieved.

The recording head (recording means) 1 is ink jet recording means for discharging the ink by the use of heat energy, comprising electricity-heat converters for generating the heat energy. Also, the recording head 1 is to perform the recording by discharging the ink through discharge orifices by utilizing the pressure difference arising by growth and shrinkage of bubbles produced owing to film boiling which takes place with the heat energy applied by the electricity-heat converters.

A discharge orifice 22A of this cartridge 1 is comprised of 128 nozzles which are arranged at a pitch of 63.5 $\mu$m.

Figure 3:
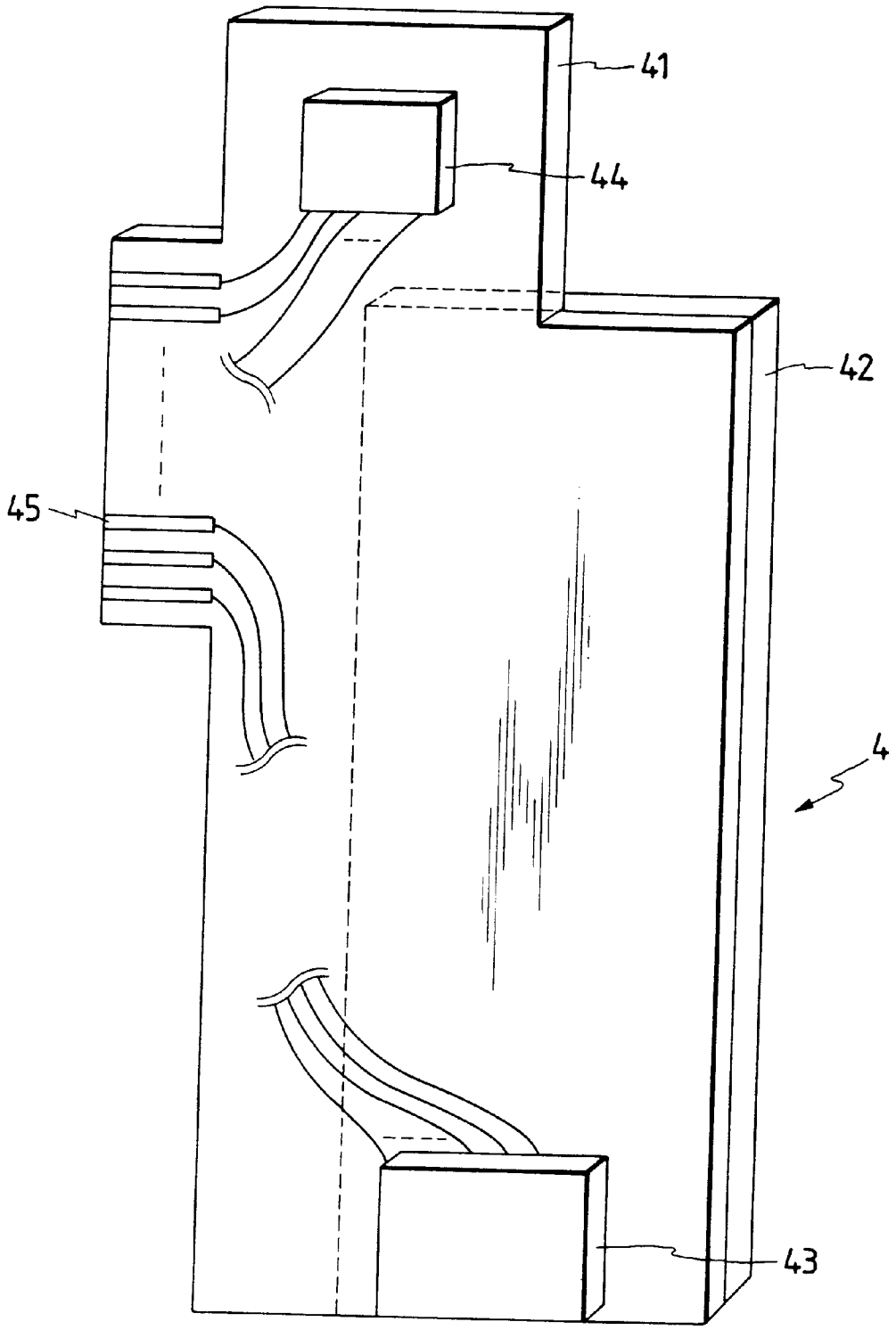
FIG. 3 is a packaging view of a print board within the ink recording head.

FIG. 3 shows schematically in appearance the essence of the ink jet recording head according to the embodiment of the present invention. In the same figure, 41 is a print substrate, 42 is an aluminum radiation plate, 43 is a heater board consisting of heat generating elements and a diode matrix, 44 is an EEPROM (voltage non-volatile memory) having prerecorded density unevenness control information and head management information, and 45 is a contact electrode serving as the joint portion with the main device. Note that a group of linear discharge orifices are not shown.

Figure 4A:
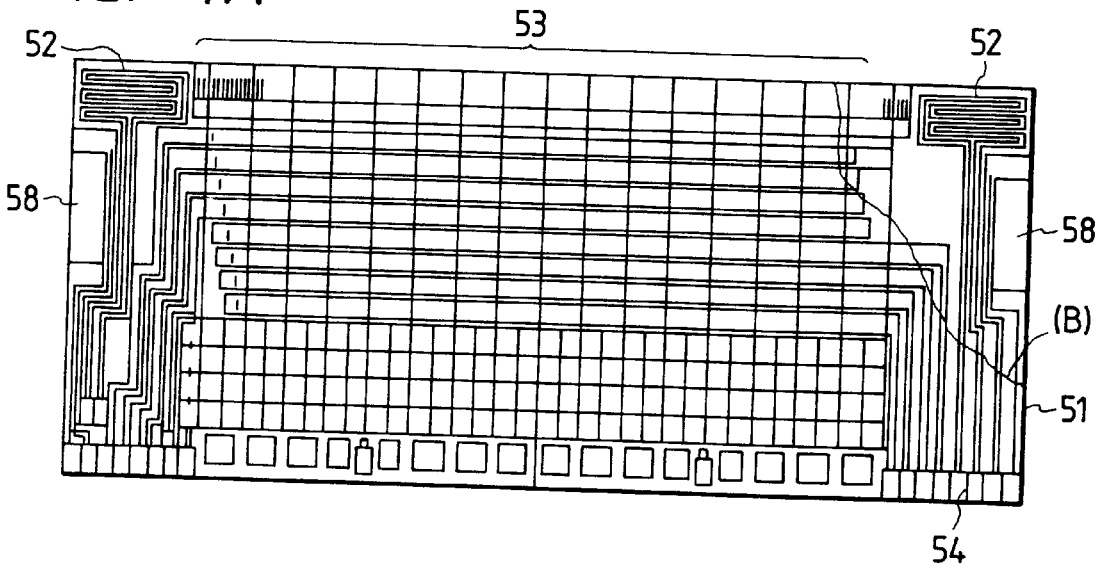
FIGS. 4A and 4B are layout diagrams of each element within a heater board.
Figure 4B:
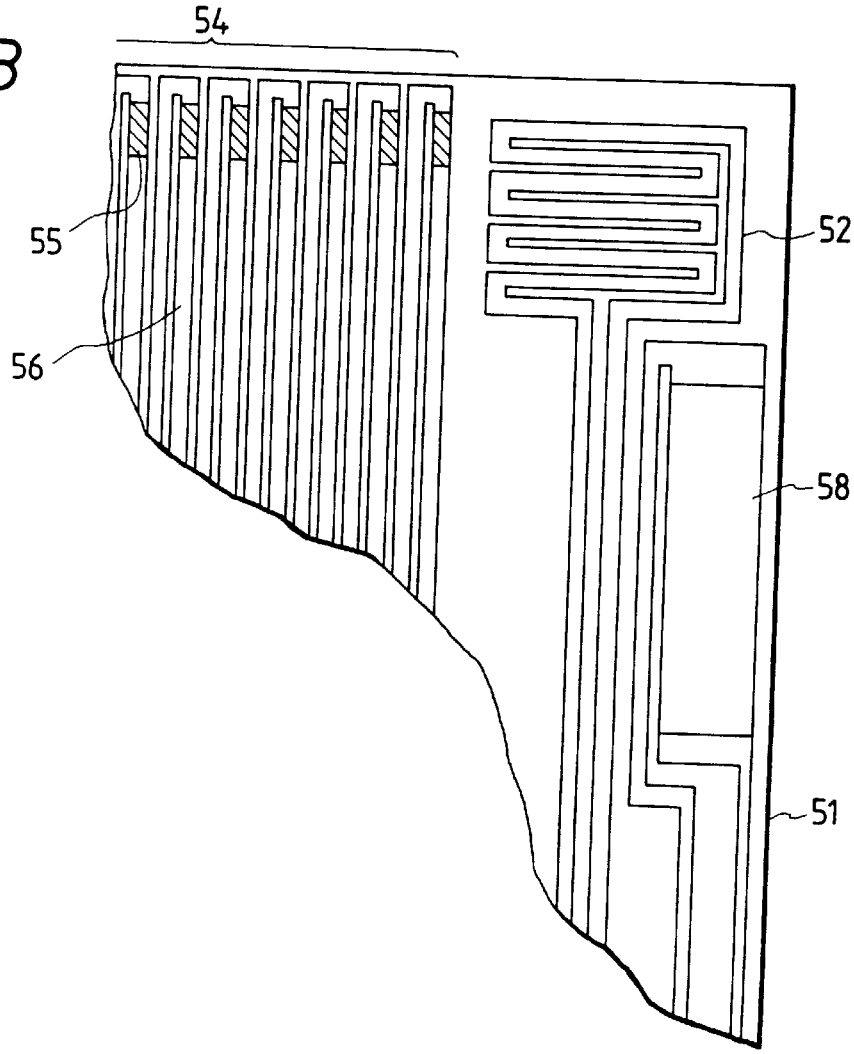

FIGS. 4A and 4B are a plan view and a partial enlarged view of the heater board according to this embodiment.

In FIG. 4A, 53 is a discharge heater portion. 54 is terminals which are connected to the outside with the wire bonding. 52 is a temperature sensor as temperature sensing means, which is formed on the discharge heater portion 53 in the same film formation process as with the discharge heater portion 53. FIG. 4B is an enlarged view of a portion B including the sensor 52 as shown in FIG. 4A, wherein 58 is a temperature retaining heater as heating means to heat the head.

The sensor 52 has a quite high precision because it is formed in the same film formation process as for the semiconductor, like the other portions, and can be made of a material the conductivity of which is variable depending on the temperature, such as aluminum, titanium, tantalum, tantalum pentoxide, niobium and the like, which is also a constituent for other portions. For example, among them, aluminum is used as a material for the electrode, titanium is used as a material disposed between the heat generating resistor layer constituting the electricity-heat converters and the electrode to enhance the adherence therebetween, and tantalum is used as a material disposed over the protective layer on the heat generating resistor layer to enhance the anti-cavitation property. Also, the line width is rendered thicker to reduce the dispersion between each process, and serpentine shape is adopted to reduce the effects of wiring resistors, thereby attaining higher resistance.

Note that the sensor 52 may be a diode to make the effective use of the characteristic of the forward voltage which varies depending on the temperature.

The temperature retaining heater 58 can be made of the same material (e.g., $HfB_2$) as the heat generating resistor layer of discharge heater 5, but may be formed of any one of other materials constituting the heater board, such as aluminum, tantalum and titanium.

Figure 5A:
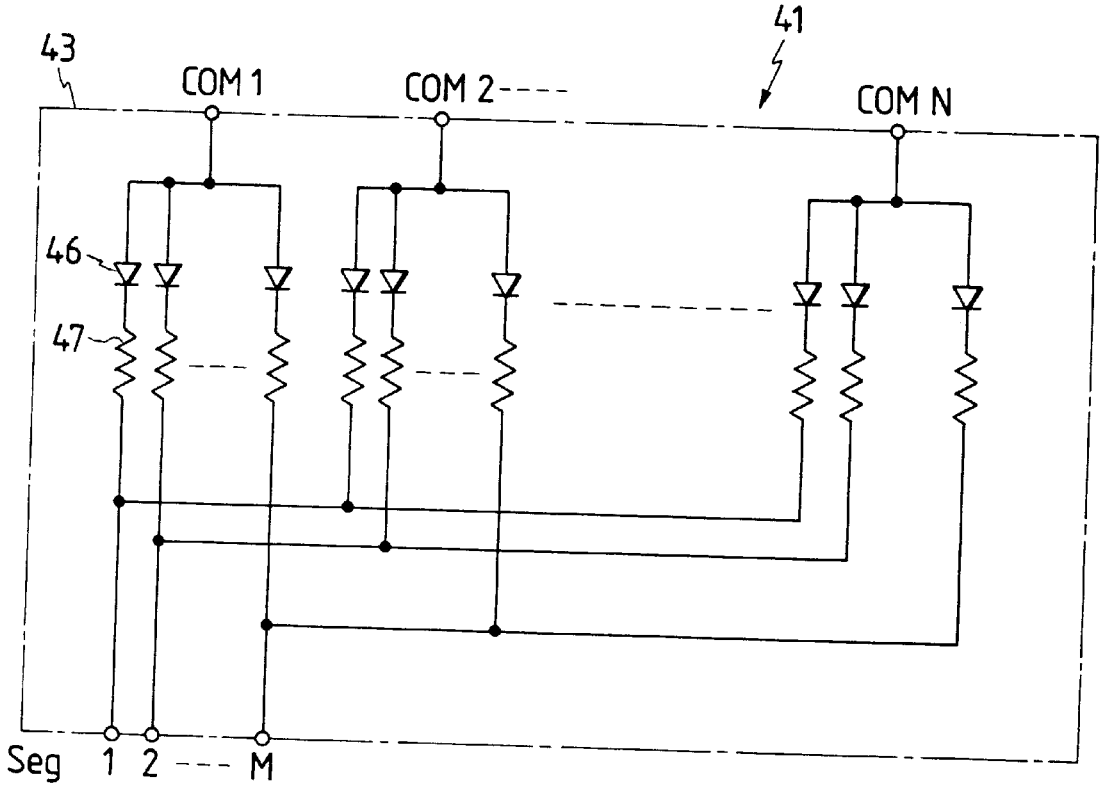
FIGS. 5A and 5B are electric circuit diagrams on the print board.
Figure 5B:
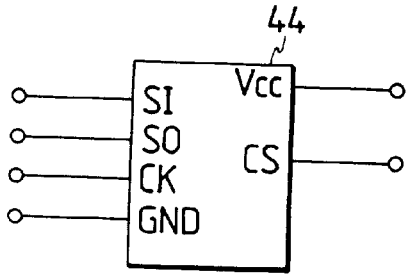
Figure 6:
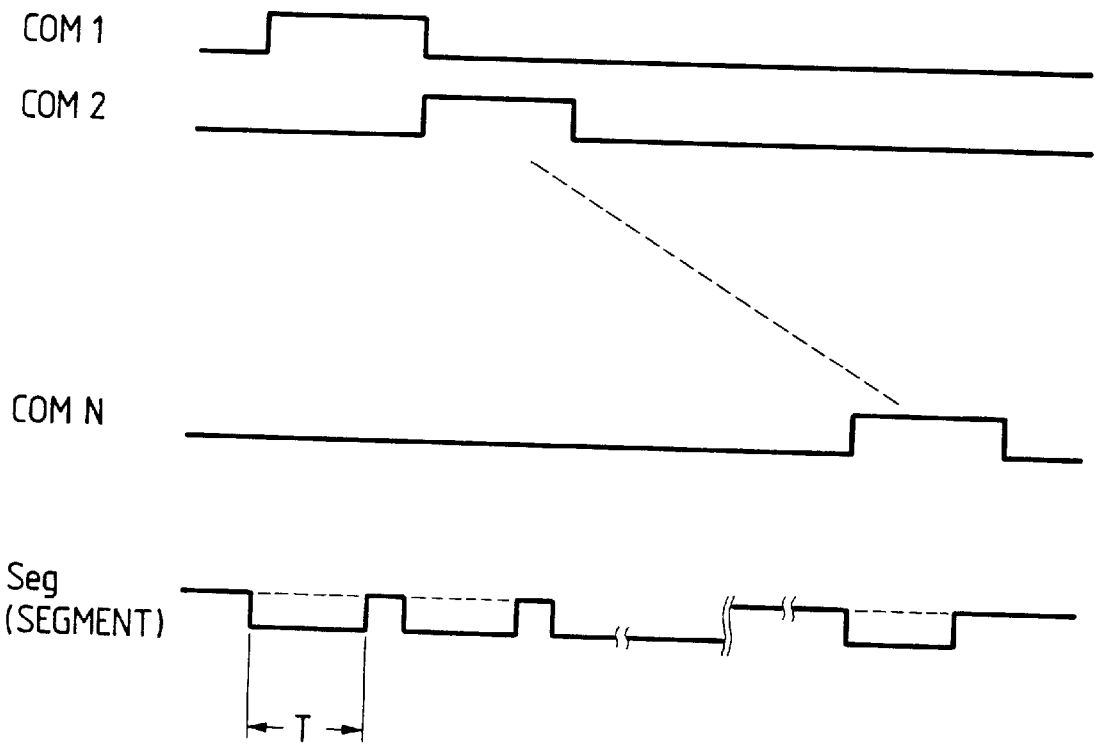
FIG. 6 is a drive timing diagram for the digit and the segment.

FIGS. 5A and 5B are diagrams showing the configuration of an essential circuit on the print substrate 41 as shown in FIG. 3. Herein, the inside of the frame enclosed by the dashed line is a circuit configuration within the heater board 43, which is constituted as an N×M (16×8 in this case) matrix of series connection circuit of heat generating elements 47 and diodes 46 for prevention of reverse current. That is, these heat generating elements 47 are driven in time division as shown in FIG. 6, wherein the amount of supplying the drive energy is controlled by the pulse width (T) to be applied to the segment (SEG) side.

FIG. 5B is a diagram showing an example of EEPROM 44 of FIG. 3, in which the control information of density unevenness inherent to the head and the head management information are stored. The information is output via serial communication to the main device in accordance with a request signal DI (address signal) from the main device, as will be described later.

FIG. 7A shows an example of data map within the EEPROM 44. A storage area is constituted of 128 bytes, the lower six bits of each byte is correction data for density unevenness inherent to the head (referred to as head shading data in this invention), and the upper two bits is various control data or management data of the head. The contents of the latter are shown in FIG. 7B. Note that the specific control of density unevenness correction or the control using various data as shown in FIG. 7B is not a direct object of the invention, and the further explanation thereof is omitted.

Figure 8A:
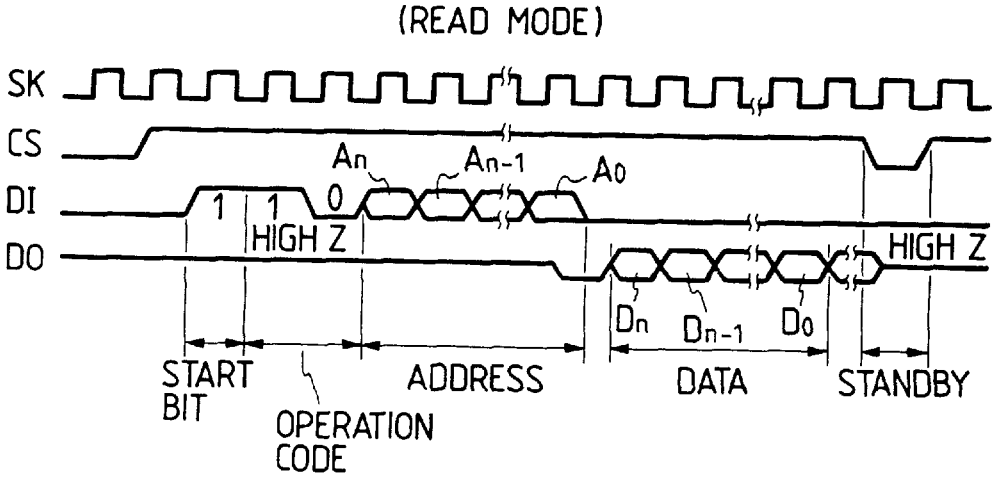
FIGS. 8A and 8B are write/read sequences of the EEPROM.
Figure 8B:
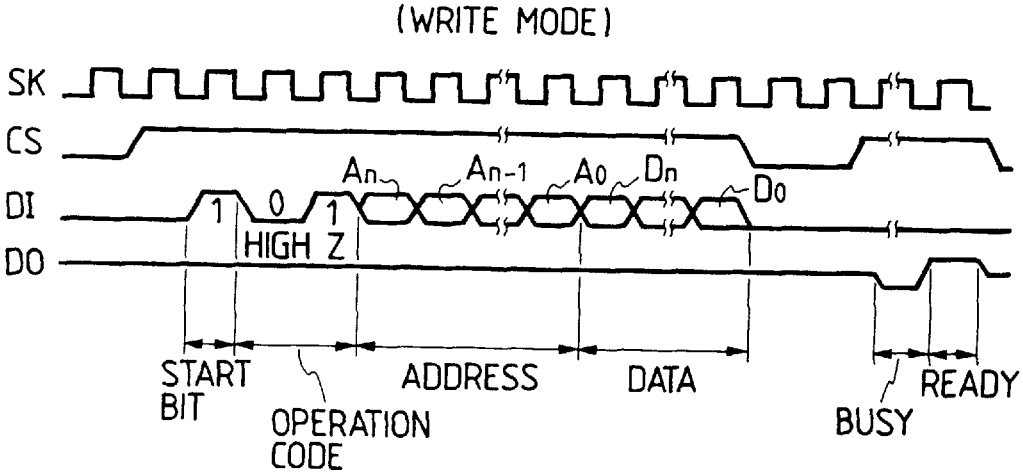

FIGS. 8A and 8B show a data read sequence from the EEPROM 44 and a data write sequence from the EEPROM, respectively.

Figure 9:
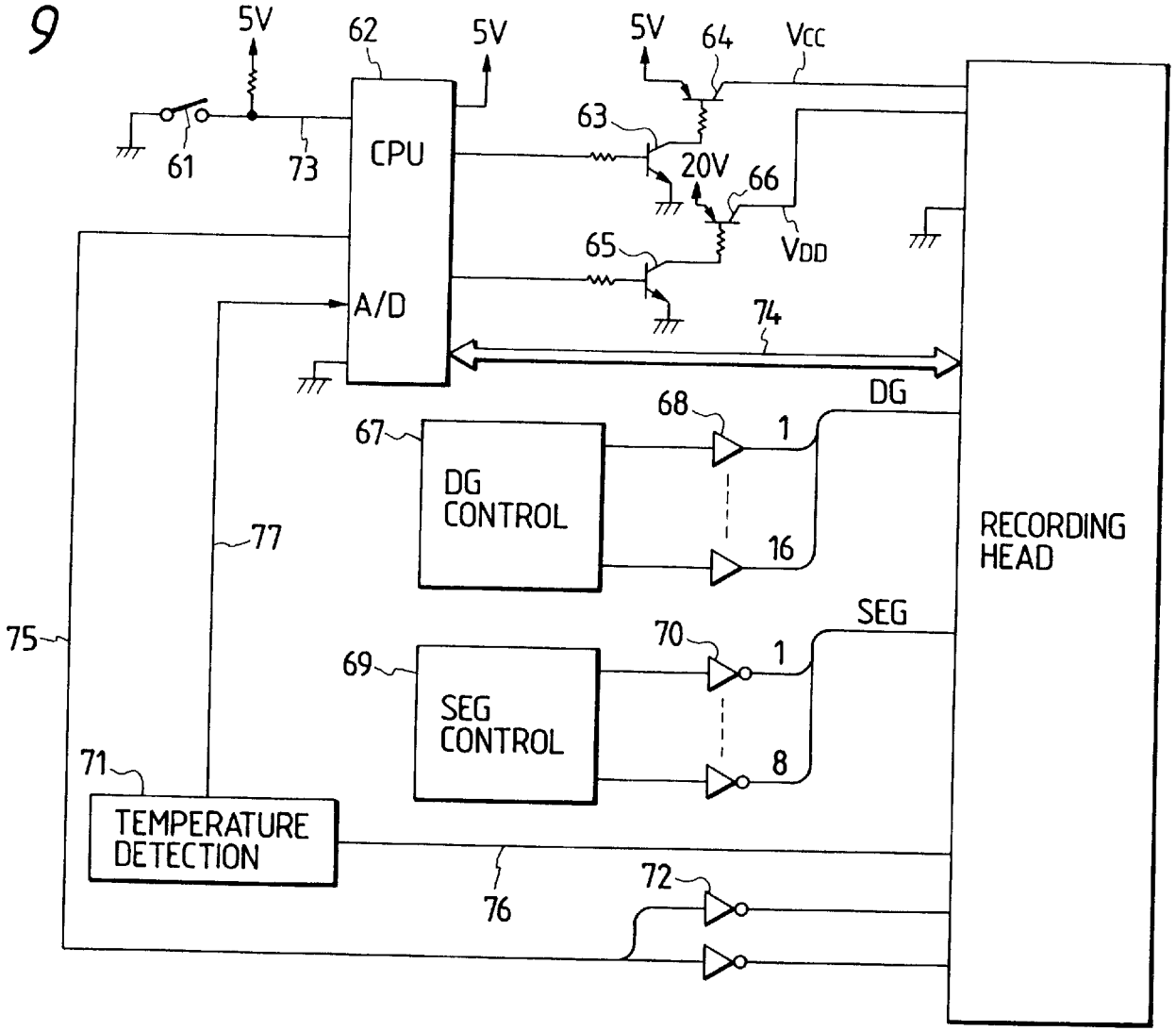
FIG. 9 is a circuit block diagram showing an embodiment of the present invention.

FIG. 9 is a typical example of circuit block diagram for use in the present invention. Switch 61 is a switch which turns on/off upon the opening or closing of a front cover of the main device, when exchanging the recording head of FIG. 1, wherein this switch turns off when the front cover is opened, while it turns on when closed. This operation is not necessarily interlocked with the front cover, but can serve the purpose of the present invention as long as it opens protecting means for the recording head to render the recording head in a detachable state. Accordingly, an input signal 73 to a CPU 62 gets H when the front cover is opened, and gets L when it is closed. If the CPU 62 knows that the front cover is opened upon detecting the variation in this input signal, the CPU 62 turns off transistors 63 and 65, and shuts off power supplies $V_{CC}$ and $V_{DD}$ to the recording head. $V_{CC}$ is 5V as previously mentioned, and $V_{DD}$ is a power source (20V) for the power supply to the temperature retaining heater 58 (FIG. 4) of the head. The temperature retaining heater 58 is turned on/off via a driver 72 from the CPU 62, in accordance with the indicated temperature of a temperature sensor 52 within the heater board of FIG. 4. The signal of the temperature sensor 52 is input to a temperature detection circuit 71, converted into an appropriate analog value, and input into an A/D conversion board of the CPU 62. A signal line 74 (FIG. 9) makes the EEPROM 44 for the recording head as shown in FIGS. 3 and 5 correspond to a control line for the communication with the CPU 62. The digit (DG) control and the segment (SEG) control take control of driving the recording head with a matrix structure of 16 digits×8 segments used in this invention.

Figure 10:
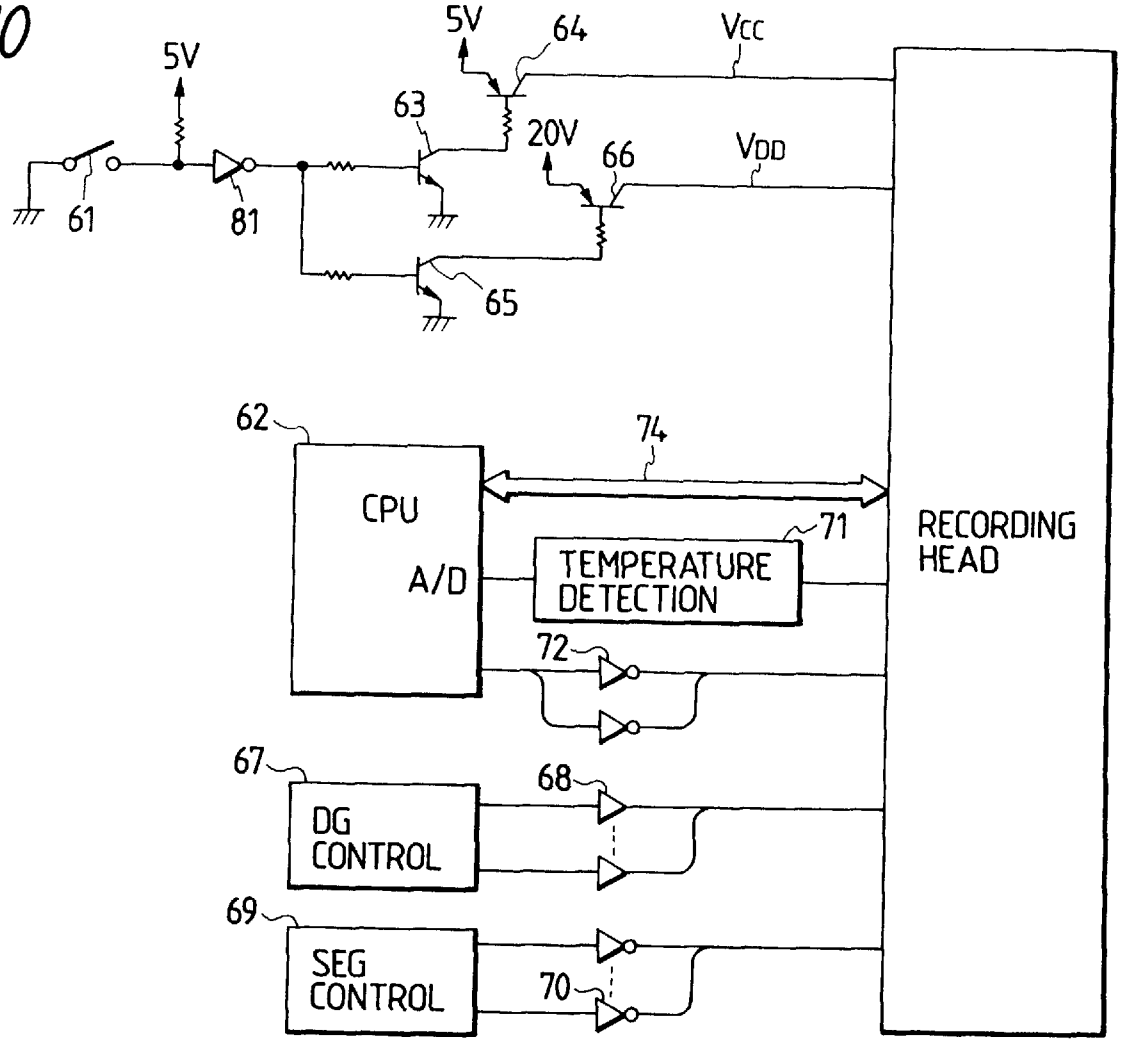
FIG. 10 is a circuit block diagram of another embodiment of the present invention.

FIG. 10 is a circuit block diagram showing another embodiment of the present invention. Like elements or circuits as used in FIG. 9 are indicated by the same reference numerals. Herein, though the switch 61 is provided on the same front cover as in the previous embodiment, its signal is not directly input into the CPU 62, but $V_{CC}$ and $V_{DD}$ are directly shut off by the hardware when the front cover is opened.

Since the unit element is constituted in the present invention as previously described, the protection for stored information or control circuit within the head in detaching the head is accomplished by shutting off the power supply to the recording head prior to detaching the recording head.

Figure 11:
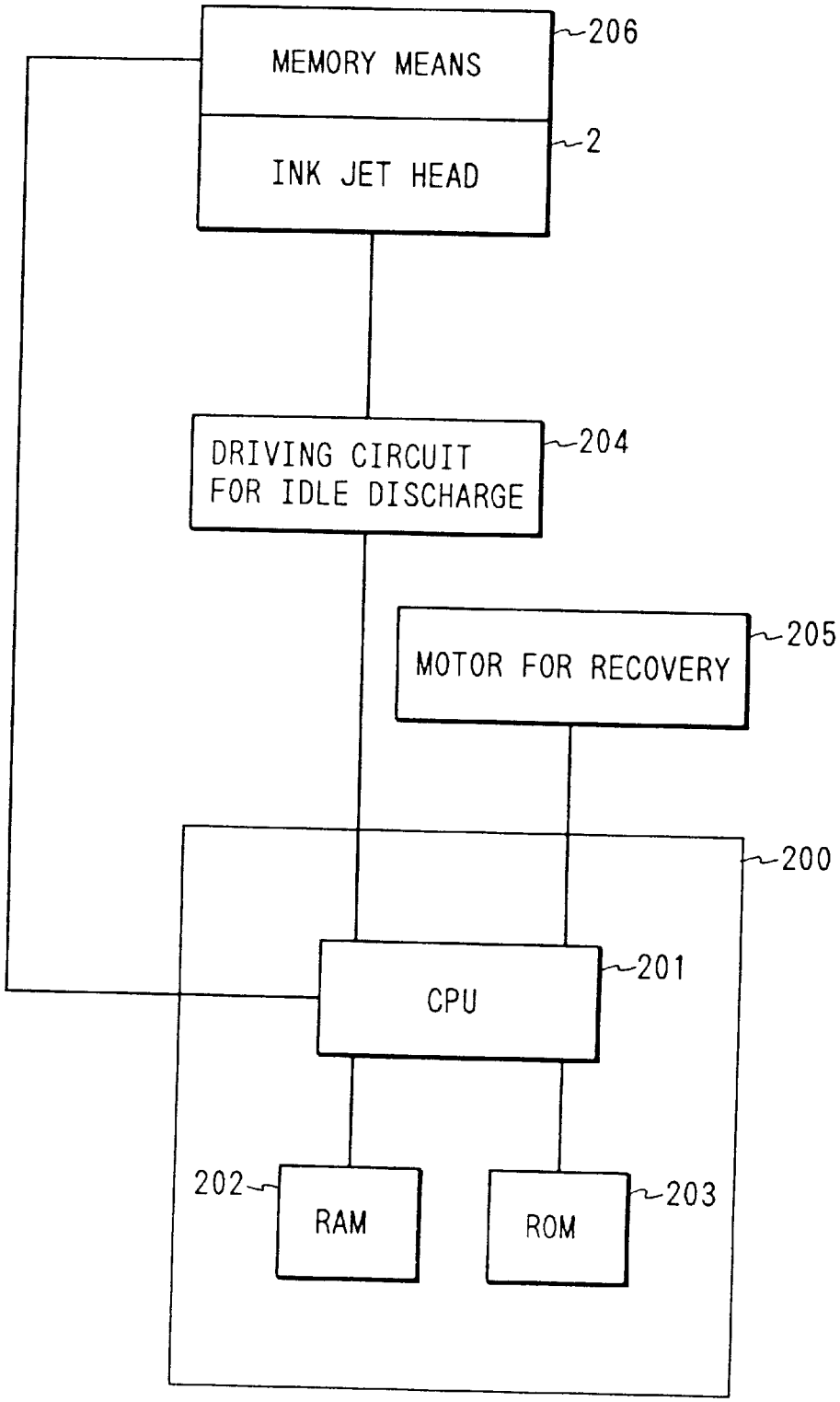
FIG. 11 is a diagram showing a portion related to the recovery operation in a control block of the apparatus.

FIG. 11 is a diagram showing the control for a recovery operation portion in the apparatus as above described.

200 is a control unit having a CPU 201 for executing the processings to be performed in the ink jet recording apparatus, a ROM 202 for the storage of fixed data such as programs corresponding to processing means, and a RAM 203 for the work area.

The control unit 200 is connected to an idle discharge driving circuit 204 for driving the head for the idle discharge, a recovery motor 205, and memory means 206 within the head cartridge 1 in the ink jet head 2, as well as each unit for the print process, so that the overall operation of the ink jet recording apparatus is controlled. The memory means 206 provided on the ink jet head 2 stores the print history of the ink jet head 2, whereby the control unit 200 confirms the service condition of the head cartridge 9 from the contents of the memory means 206. The memory means 206 is an EEPROM in this embodiment.

Figure 12:
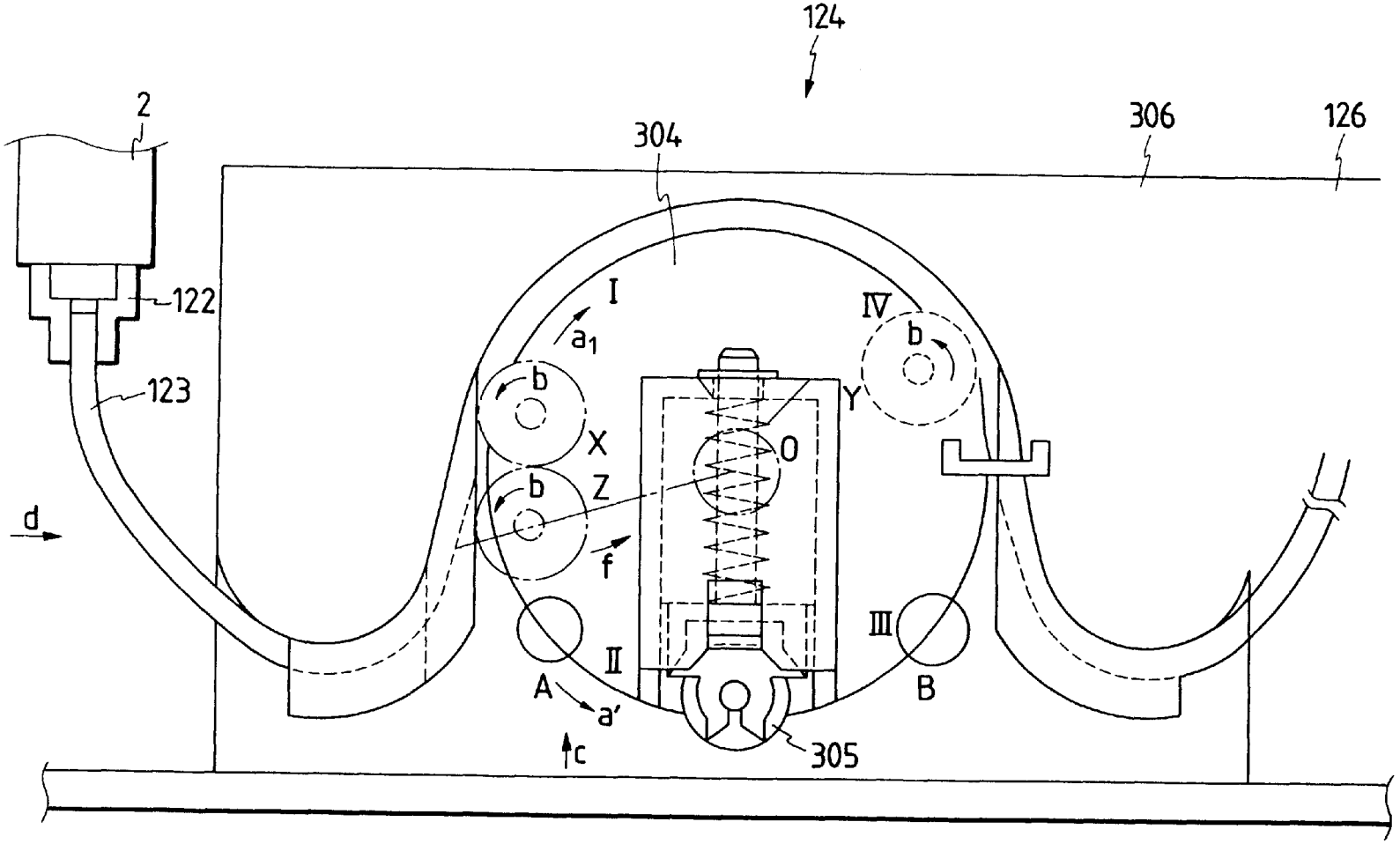
FIG. 12 is a view showing the constitution of a tube pump 53 serving as a recovery motor for allowing the ink jet head 1 to effect an idle discharge.

FIG. 12 is a view showing the constitution of a tube pump 124 serving as the recovery motor which is suction means for allowing the ink jet head 2 to perform the idle discharge in this embodiment.

In the suction recovery operation, an opening portion of a cap 122 is brought into contact with the ink jet head 2 at a non-print position, thereby forming a closed scheme in the discharge orifice portion. To another side of the opening portion of the cap 122 is connected a tube 123. The tube 123 forms a tube pump portion with a guide roller 304, a pressure roller 305, and a pump base 306. On one side of the tube 123 is arranged a waste ink treating member 126. The waste ink treating member 126 serves to reserve the ink drawn through discharge orifices with the suction operation.

If the guide roller 304 is rotated in a direction of the arrow d, the pressure roller 305 presses the tube 123 at a position X. The pressure roller compresses the tube until the space within the tube in contact with the pressure roller becomes zero. If the guide roller 304 is further rotated in the direction of the arrow d from the state of X, the pressure roller 305 is rotatably driven in a direction of the arrow b, with the tube 123 compressed. And it temporarily stops at a position Y. At this time, a negative pressure will occur between the positions X and Y, due to the variation of volume within the tube compressed by the pressure roller, so that the suction operation is effected.

The home position of the tube pump is a position B. This position is an initial position of the tube pump. At this position, the tube is not compressed by the pressure roller.

It is a cap member that accepts the ink produced by the idle discharge from the head, wherein in the idle discharge with a high possibility of a relatively great amount of ink being discharged, the idle rotation is preferred. The idle rotation herein referred to is meant to activate the pump in a state in which the head is not capped to prevent the ink from overflowing out of the cap. In such idle rotation, the guide roller is rotated as previously described, with the head 3 being in non-contact with the cap 122.

For both the suction operation and the idle rotation operation, the start position of the roller 305 is a position B.

The timing to start the idle discharge is when the roller 305 of the guide roller arrives at a position X.

If the recovery motor is stopped, the roller is stopped at a position B, upon which the idle discharge state is terminated.

The control operation in this embodiment will be described below.

Figure 13:
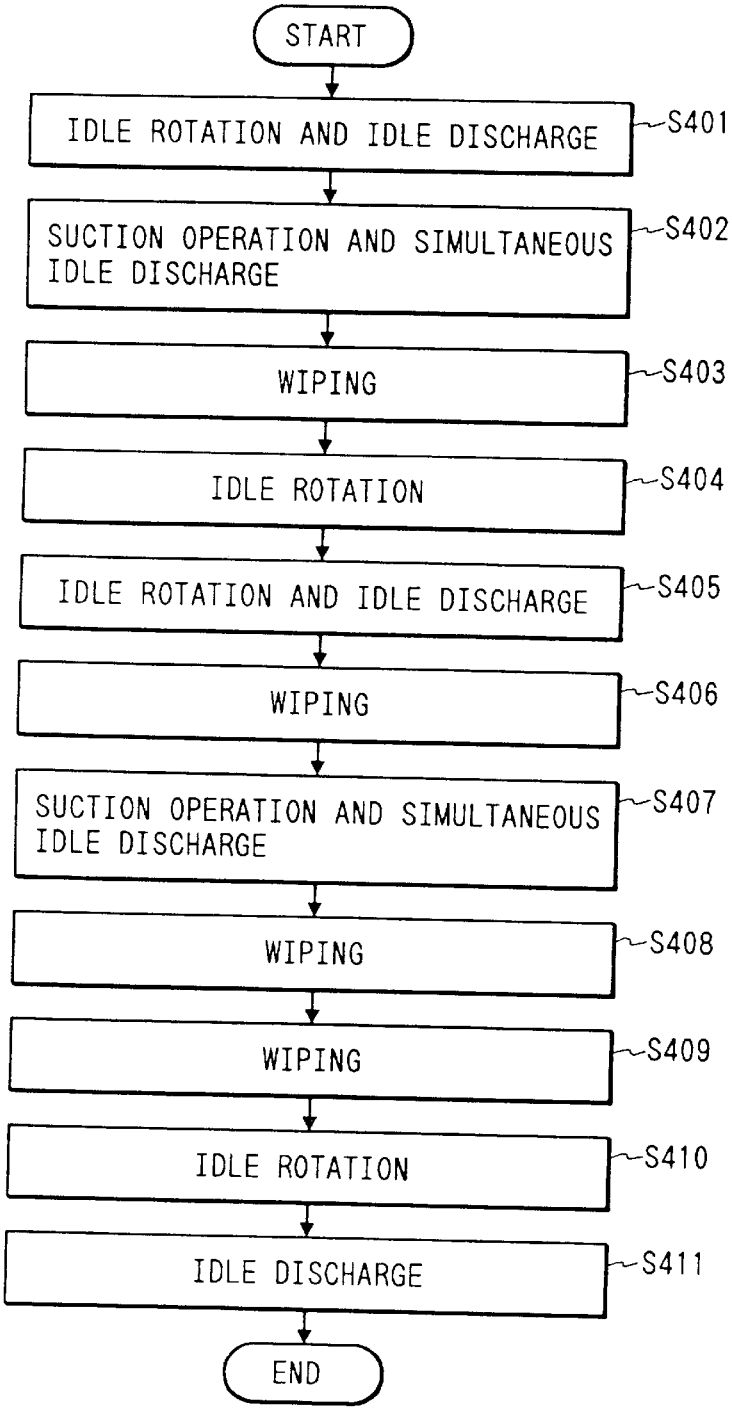
FIG. 13 is a flowchart showing a processing procedure for the recovery operation.

FIG. 13 is a flowchart showing a processing procedure of the recovery operation to be performed in this invention.

Upon turning on the power of the ink jet recording apparatus, the control unit 200 judges whether or not the ink jet head 2 of the ink jet recording apparatus is newly mounted, based on the contents of memory means 206, and executes the recovery operation if it is a new head.

If the ink jet head 2 is a new head, the idle discharge is performed along with the idle rotation of the tube pump at step S401. The number of idle discharges is 10000, with its drive frequency at 4 kHz.

At step S402, the suction operation is performed along with the idle discharge.

At step S403, the wiping operation is performed.

At step S404, the idle rotation is made corresponding to one rotation of the tube pump.

At step S405, the idle discharge is performed again along with the idle rotation. This operation is the same as that at step S401.

At step S406, the wiping is performed.

At step S407, the suction operation is performed along with the idle discharge. This operation is the same as that at step S402.

At steps S408 and S409, the wiping is performed consecutively. At step S410, the idle rotation is performed.

At final step S411, the idle discharge is performed 200 times at a drive frequency of 1 kHz.

Note that the idle discharge operation simultaneously performed with the suction operation at steps S402 and S407 is 5000 times at a drive frequency of 4 kHz, respectively. This idle discharge is conducted to prevent the thicker ink to be removed by the wiping from entering the discharge orifices.

This recovery operation will be performed if there is a new head mounted when the power of the ink jet recording apparatus is turned on.

Figure 14:
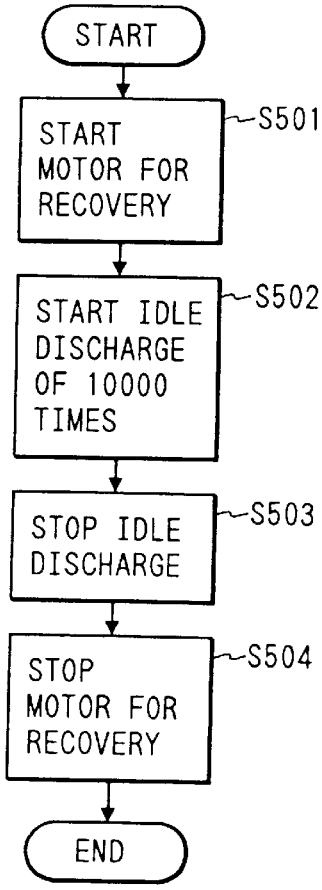
FIG. 14 is a flowchart showing the idle discharge operation which is performed at step S401 in FIG. 13.

FIG. 14 is a flowchart showing an idle discharge operation to be performed at step S401.

To perform the idle discharge operation, the recovery motor is started (step S501), and then, the idle discharge of 1000 times is conducted at the above timing (step S502). Subsequently, after the idle discharge is stopped (step S503), the recovery motor is stopped (step S501).

In this embodiment, the number of idle rotations is two.

In this embodiment, it is possible to prevent the gradation in image quality even when using a new head stored for a very long term, because the recovery operation is performed by detecting whether or not the ink jet head is a new one.

Also, this processing is effective for the use of color. This embodiment is implemented in the ink jet recording apparatus in which a plurality of recording heads, for example, four color heads of Y, M, C and Bk, are mountable thereon.

In the ink jet recording apparatus as above constituted, except when the recording heads for all four colors are exchanged, the head of which the color ink is more often used, for example, the head of Bk, may be only exchanged.

In this case, if the recovery operation as described in the previous embodiment is performed for the recording heads of Y, M and C which are not new heads, the recovery operation itself is not of any inconvenience, but the consumption amount of ink undesirably increases. Thus, the idle discharge is controlled so as to be only performed for the new head, except for the old heads, during the idle discharge suction which is performed simultaneously with the idle rotation.

Figure 15:
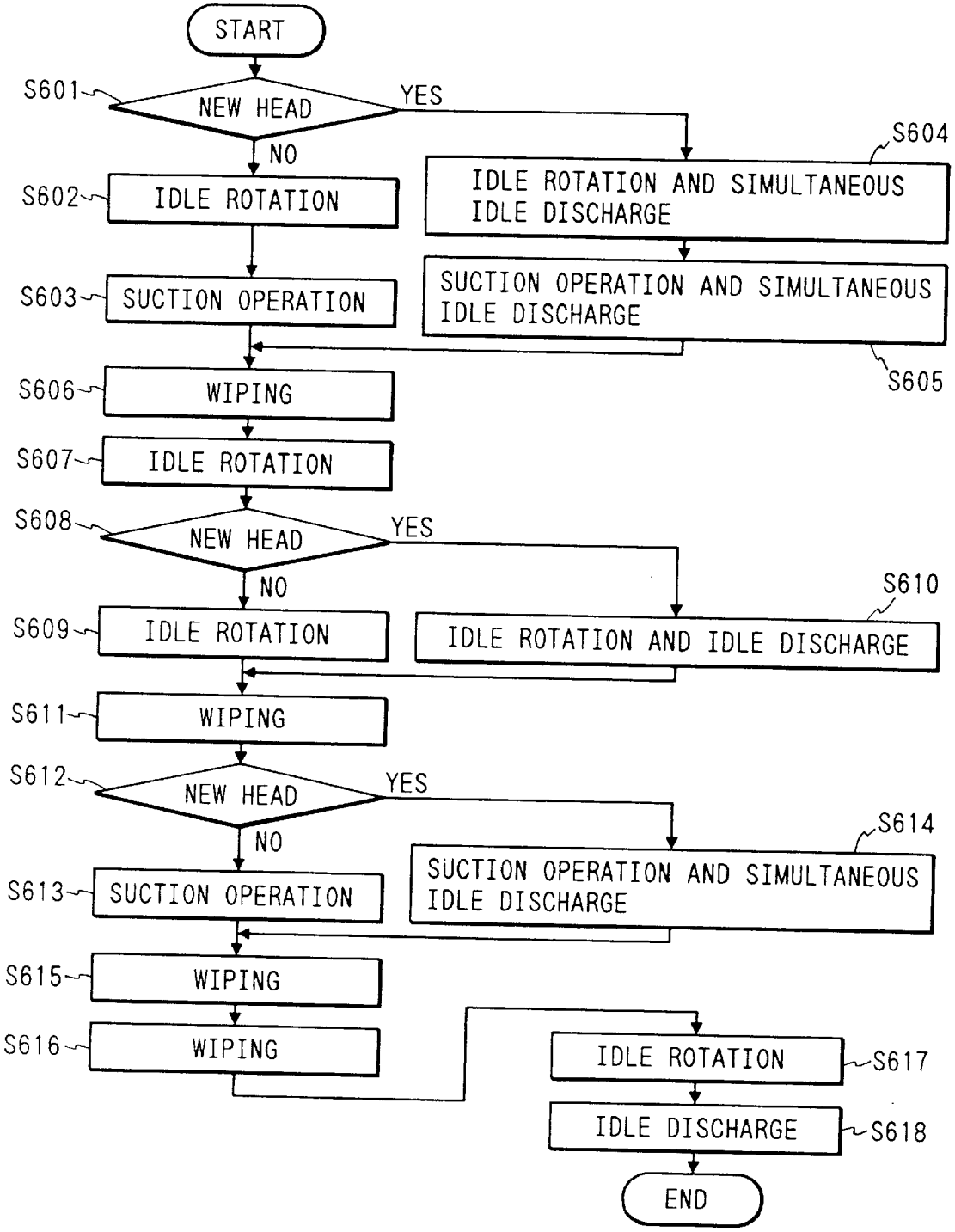
FIG. 15 is a flowchart showing another processing procedure for the recovery operation.

Since the constitution of the apparatus according to this embodiment is substantially the same as that of the previous embodiment, the recovery operation is only shown with a flowchart in FIG. 15.

Upon turning on the power of the ink jet recording apparatus, the control unit judges whether or not each head is a new head, based on the print history of each head (step S601). Herein, for example, when the Bk head alone is a new head, the procedure proceeds to step S602 and step S603 for three heads of Y, M and C which are old heads, wherein the idle rotation of the tube pump and the suction operation are performed.

For the new head of Bk, the procedure proceeds to step S604 and step S605, wherein the idle discharge is performed simultaneously with the idle rotation of the tube pump, and subsequently the idle discharge is performed simultaneously with the suction operation.

At steps S606 and S607, the wiping and the idle rotation for each head are performed.

At step S608, each head is judged again to determine whether or not it is a new head, wherein the Bk head alone transfers to step S610 where the idle discharge is performed simultaneously with the idle rotation, while other heads transfer to step S609 where the idle rotation is only performed.

Thereafter, each head is wiped at step S611.

At step S612, each head is judged again to determine whether or not it is a new head, wherein the Bk head alone transfers to step S614 where the idle discharge is performed simultaneously with the suction operation, while other heads transfer to step S613 where the suction operation is only performed.

Since the transfer processing is done for each head, the wiping operation is consecutively performed at steps S615 and S616.

At step S617, the idle rotation is performed.

At final step S618, the idle discharge of 200 times is conducted at a drive frequency of 1 kHz, and the procedure is ended. This operation is intended to prevent the thicker ink to be removed in wiping from entering discharge orifices, thereby producing the mixing of colors.

With this control, the ink consumption amount of Y, M and C can be saved 0.1 g (amounting to 30000 times of discharge) (10000 times at the idle rotation+5000 times at the suction+10000 times at the idle rotation+5000 times at the suction).

While the recovery operation of new head is performed during the power-on in the above described embodiments, it will be appreciated that the recovery operation may be initiated after the attaching operation of the head, or with the key input from the user, for example.

The more effective wiping method will be described below.

(1) After compulsorily discharging the ink using a cap 122, the remaining ink 221 left on the discharge orifice formation face 22A of the recording head 2 will wet the thicker ink 222 adhering to the periphery around discharge orifices 22A by the wiping with the rubber blade 130 at the first time, thereby decreasing the viscosity of the thicker ink 222.

(2) Since the low viscous remaining ink 221 having high surface tension can be almost all removed by the wiping with the rubber blade 130 at the first time, when the wiping is subsequently performed with the rubber blade 130 at the second time and beyond, it is possible to exert a strong pressing force against the discharge orifice formation face 22B without the rubber blade 130 sliding on the discharge orifice formation face 22B.

Figure 19A:
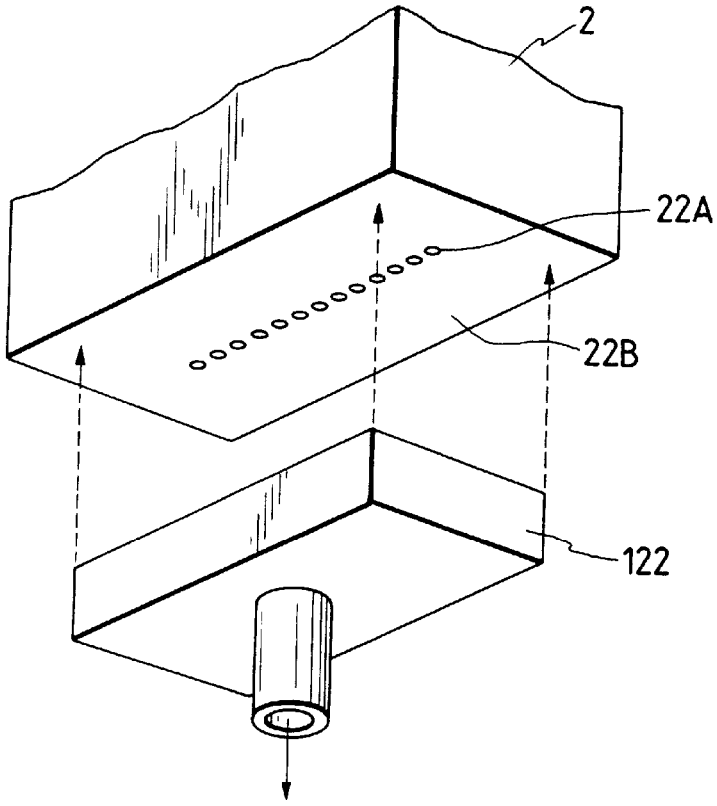
Figure 19B:
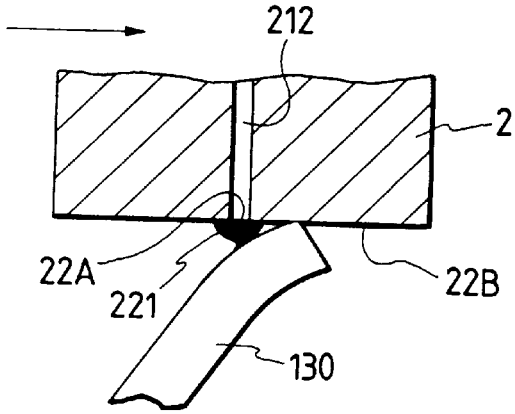

The ink jet recording apparatus in which the discharge recovery method according to this embodiment can be implemented, like the ink jet recording apparatus as shown in FIG. 19, comprises a cap 122 (see FIG. 19A) as the first discharge recovery means for compulsorily discharging the ink through discharge orifices 22A of the recording head 2, and a rubber blade 130 as the second discharge recovery means for wiping away adherents adhering to the periphery around discharge orifices 22A with an elastic member, each discharge orifice 22A communicating via a liquid channel 212 to a common ink liquid chamber (not shown), to which the ink is supplied from the ink tank (not shown). Also, the inside of the cap 122 which communicates to a pump (not shown) is rendered a negative pressure by the pump.

Figure 16A:
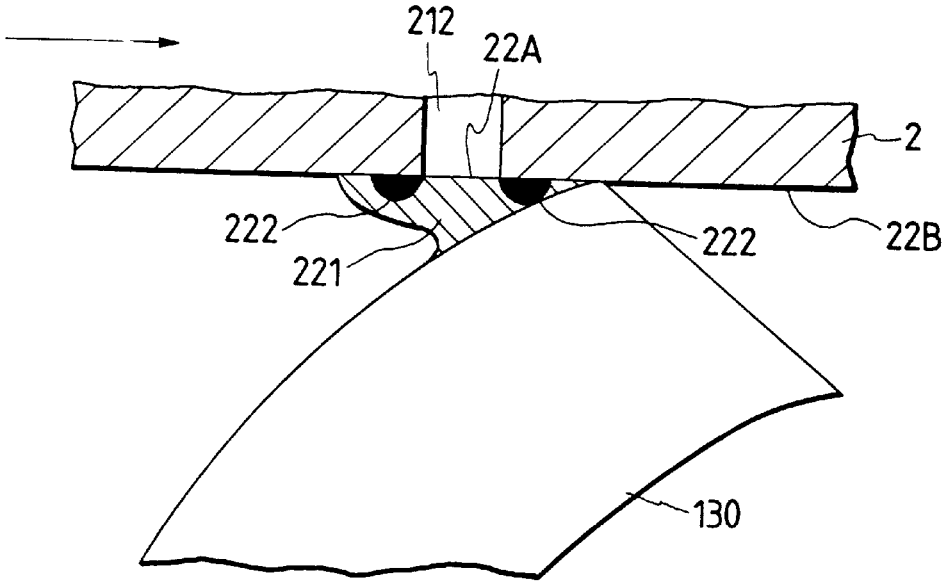
Figure 16B:
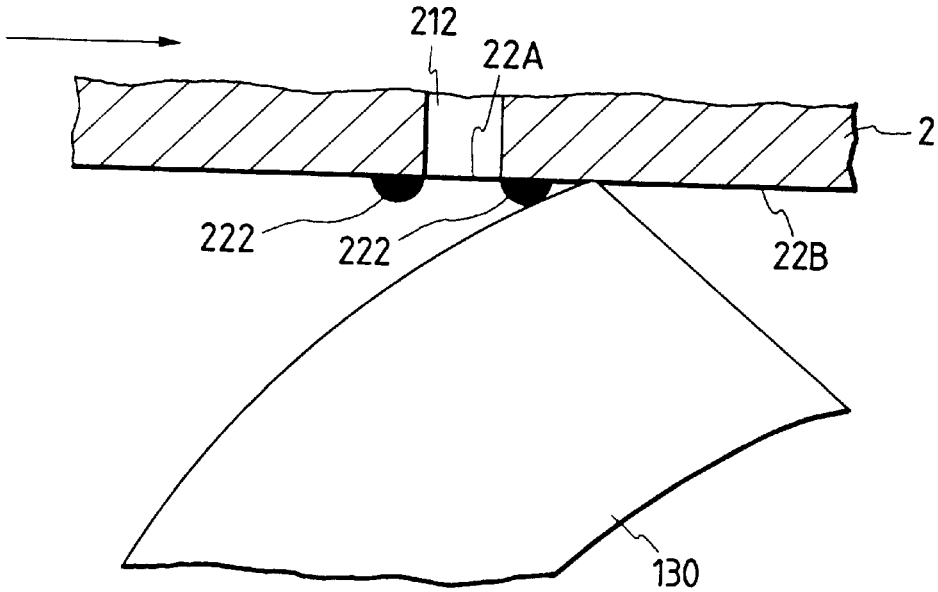

When the discharge recovery operation is performed with the discharge recovery method of the ink jet recording apparatus in this embodiment, the inside of the cap 122 is rendered a negative pressure by the pump, after the discharge orifice formation face 22B of the recording head 2 is capped by the cap 122, whereupon the ink is poured from the ink tank into the ink liquid chamber, and compulsorily discharged from each discharge orifice via the liquid channel 212 into the cap 122. Thereafter, the rubber blade 130 is brought into contact with the discharge orifice formation face 22B of the recording head 2, as shown in FIG. 16A, and the recording head 2 is moved in a direction of the arrow as shown to wipe away adherents adhering to the periphery around the discharge orifices 22A, while the remaining ink 221 left on the discharge orifice formation face 22B of the recording head 2 may be interposed between the discharge orifice formation face 22B and the rubber blade 130 to give rise to a kind of hydroplaining phenomenon, causing the rubber blade 130 to slide on the discharge orifice formation face 22B, so that the pressing force (pressure) of the rubber blade 130 against the discharge orifice formation face 22 is reduced. Accordingly, by wiping with the rubber blade 130, the low viscous remaining ink 21 having high surface tension produced by compulsorily discharging the ink, and adherents adhering to the periphery around the discharge orifice formation face 22A can be removed as long as they have only weak adhering force to the discharge orifice formation face 22B, but the thicker ink which has strong adhering force to the discharge orifice formation face 22B, among the adherents adhering to the periphery around the discharge orifices 22A, can not be removed, and will be left on the discharge orifice formation face 22B as shown in FIG. 16B.

Hence, the wiping is performed again by the rubber blade 130. Since the remaining ink 221 is almost removed by the wiping with the rubber blade 130 at the first time, there occur neither hydroplaining phenomenon as previously mentioned, nor reduction in the pressing force of the rubber blade against the discharge orifice formation face 22B. Also, the thicker ink 222 left on the discharge orifice formation face 22B is caused to be wet due to the remaining ink 221, resulting in less viscosity thereof. Accordingly, the thicker ink 1 can be relatively easily removed by the wiping with the rubber blade 130 at the second times. Thereafter, by further repeating the wiping with the rubber blade 130, the thicker ink 222 can be completely removed.

The following variations of the discharge recovery method with the wiping in the ink jet recording apparatus according to this embodiment are provided.

(1) First Variation

The relative travel speed between the discharge orifice formation face 22B and the rubber blade 130, when wiped with the rubber blade 130 at the first time, is made slower than that when wiped with the rubber blade 130 at the second time and beyond. Thereby, the time that the thicker ink 222 is caused to be wet due to the remaining ink 221 is made longer in wiping the rubber blade 130 at the first time, thereby further reducing the viscosity of the thicker ink 222, so that the removal of thicker ink 222 is further facilitated in wiping with the rubber blade 130 at the second time and beyond.

(2) Second Variation

When wiping with the rubber blade 130 at the first time, the relative travel speed between the discharge orifice formation face 22B and the rubber blade 130 is made slower in the neighborhood of the discharge orifice 22A. Thereby, in wiping with the rubber blade 130 at the first time, the remaining ink 221 left on the discharge orifice formation face 22B by compulsorily discharging the ink is collected by the rubber blade 130 to be reserved in the neighborhood of the discharge orifice 22A, so that the thicker ink is more easily wetted due to the remaining ink 221. Thus, the viscosity of thicker ink 222 is further reduced, so that the removal of thicker ink is further facilitated in wiping with the rubber blade 130 at the second time and beyond.

(3) Third Variation

When wiping with the rubber blade at the first time, the relative movement between the discharge orifice formation face 22B and the rubber blade 130 is temporarily stopped near the discharge orifice 22A. Thereby, in wiping with the rubber blade 130 at the first time, the time that the thicker ink 222 is wetted by the remaining ink 221 is made longer, thereby further reducing the viscosity of thicker ink 222, so that the removal of thicker ink 222 is further facilitated in wiping with the rubber blade 130 at the second time and beyond.

(4) Fourth Variation

The operation of wiping with the rubber blade 130 plural times after compulsorily discharging the ink using the cap 122 is repeated plural times. Thereby, the thicker ink 222 can be removed in greater amount than with one operation of wiping with the rubber blade 130 plural times after compulsorily discharging the ink using the cap 122.

(5) Fifth Variation

In the fourth variation as previously described, the force (i.e., suction force of the pump) with which the ink is compulsorily discharged using the cap 122 at the second time and beyond is made smaller than that at the first time. Thereby, the ink consumption amount when compulsorily discharging the ink can be reduced. Note that because the compulsory discharging of the ink using the cap 122 at the second time and beyond is conducted in order to leave the ink for wetting the thicker ink 222 on the discharge orifice formation face 22B, there is no particular problem even if the force of compulsorily discharging the ink using the cap 122 at the second time and beyond is reduced.

Figure 17A:
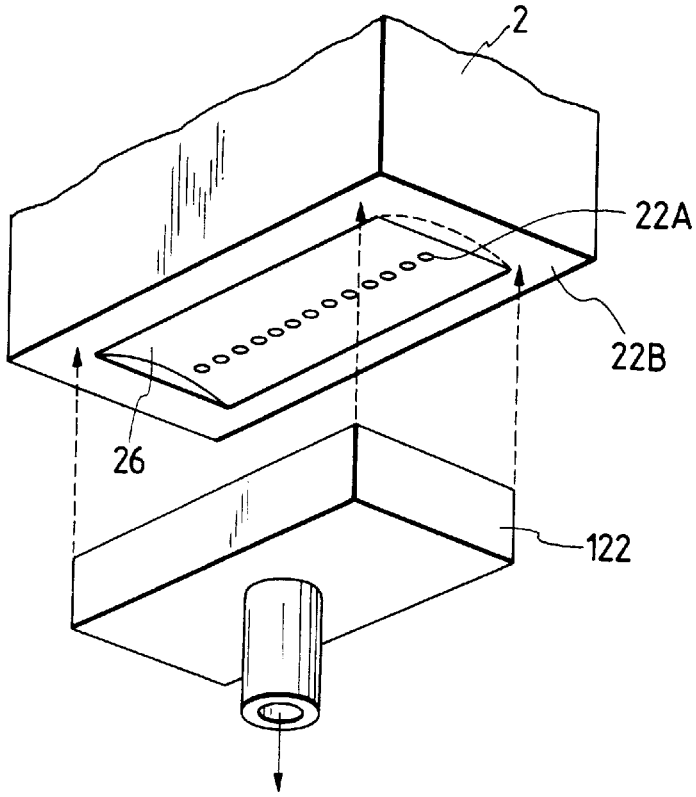
Figure 17B:
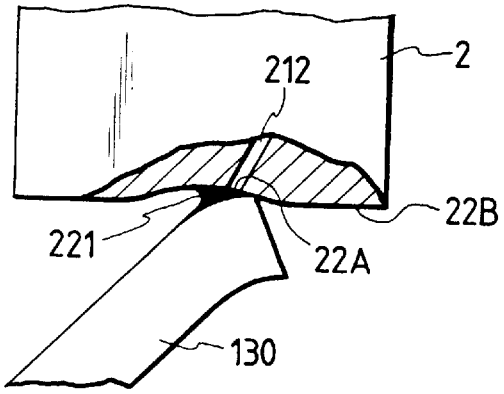

Referring now to FIGS. 17A and 17B, the constitution of the ink jet recording apparatus in which the second and third variations are particularly effective will be described below.

This ink jet recording apparatus is different from the ink jet recording apparatus of FIG. 19 in that the concave plane 26 of arcuate shape in side cross section is formed in a central portion of the discharge orifice formation face 22B, as shown in FIGS. 17A and 17B, and each discharge orifice 22A is formed slightly off-center of the concave plane 26.

Figure 18A:
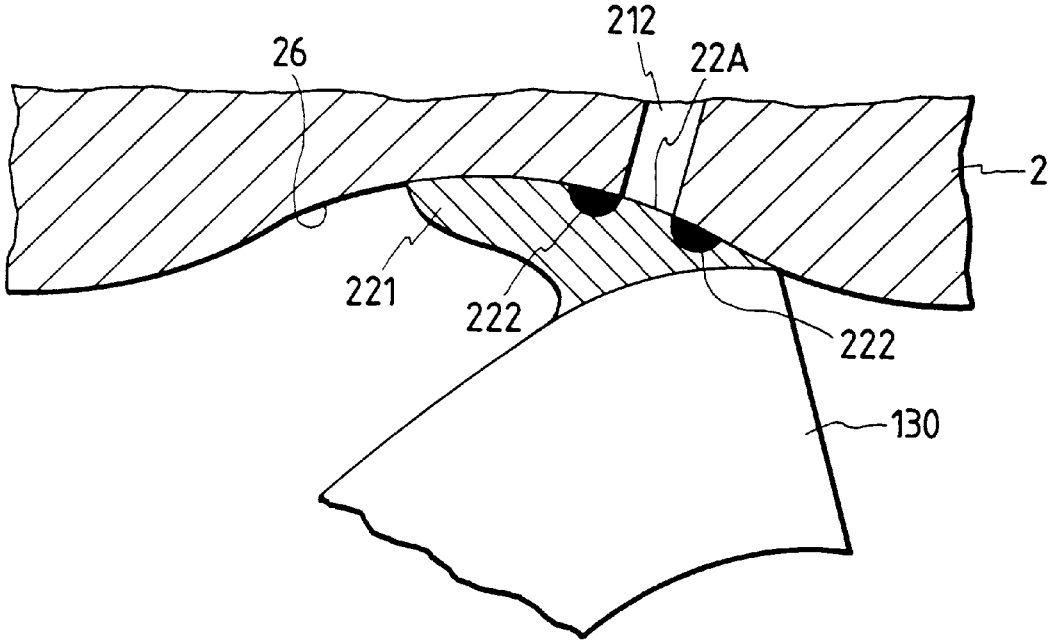
Figure 18B:
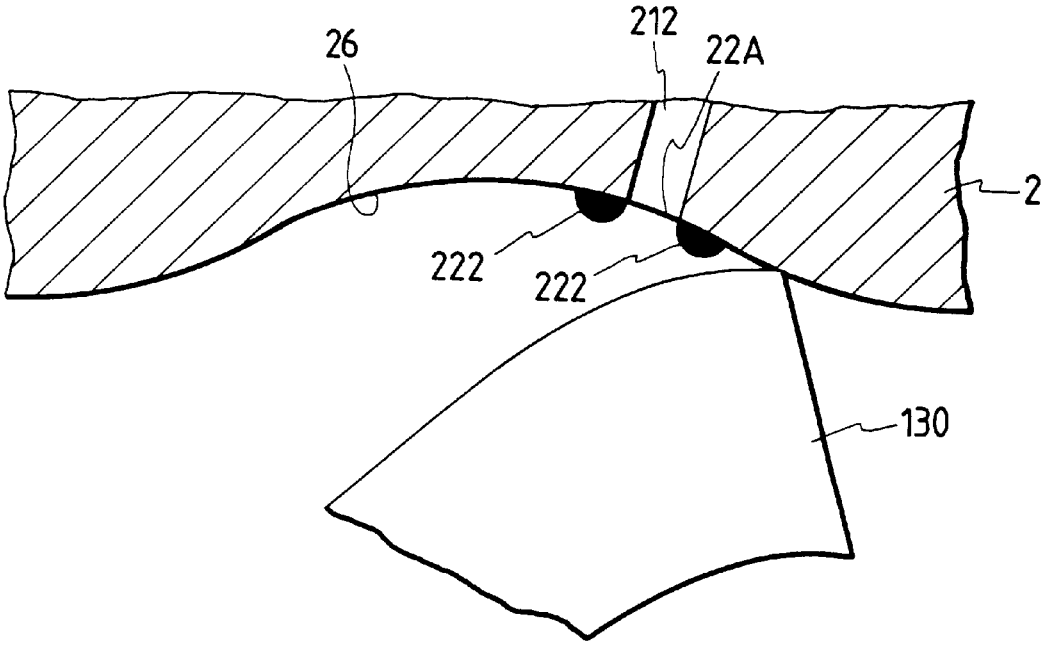

With this ink jet recording apparatus, owing to the concave plane 26 formed in the discharge orifice formation face 22B, the remaining ink is more easily reserved in the neighborhood of the discharge orifice 22A as shown in FIG. 18A than when the discharge orifice formation face 22B is planar, in wiping with the rubber blade 130 at the first time, so that the thicker ink 222 is more easily wetted by the remaining ink 221. Accordingly, in wiping with the rubber blade 130 at the second time and beyond, the thicker ink 222 can be more easily removed.

Also, with this ink jet recording apparatus, owing to the concave plane 26 formed in the discharge orifice formation face 22B, there is a greater probability that the rubber blade 130 clears the discharge orifice 22A than when the discharge orifice formation face 22B is planar, whereby it is important that the remaining ink after suction may be removed by the wiping with rubber blade 130 at the first time.

It should be noted that this ink jet recording apparatus allows for the fourth and fifth variations as previously described.

While a cap for communicating to the pump was used as the first discharge recovery means of compulsorily discharging the ink through discharge orifices of the recording head in the above explanation, it will be appreciated that means of compulsorily discharging the ink through discharge orifices of the recording head by the pressure may be used.

Also, if there is any ink adhering to the rubber blade in wiping, the removal effect of the thicker ink may be reduced half, whereby means of removing the ink adhering to the rubber blade after wiping may be provided separately, or a water-repellent rubber blade may be used.

The present invention which is configured as above described can exhibit the following effects.

(1) Since bubbles within the ink liquid chamber and the thicker ink within the liquid channels can be removed by compulsorily discharging the ink with the first discharge recovery means, and by wiping away adherents adhering to the periphery around the discharge orifices with second discharge recovery means multiple times, the thicker ink not removed by the wiping with the second discharge recovery means at the first time can be easily removed by the wiping with the second discharge recovery means at the second time and beyond, the improvement in the discharge recovery performance can be attained.

(2) The number of compulsorily discharging the ink can be reduced, so that the ink consumption amount in the discharge recovery operation can be reduced, with less running costs.

(3) The ink consumption amount in the discharge recovery operation can be reduced, so that the amount of waste ink can be reduced, and the waste ink bottle can be made permanent and smaller.

(4) Since the waste ink bottle can be made permanent and smaller, the whole ink jet recording apparatus can be made smaller with reduced price.

When the drive source of recovery mechanism as above described is the same as that for the conveyance of recording medium, the following sequence is important.

Figure 20:
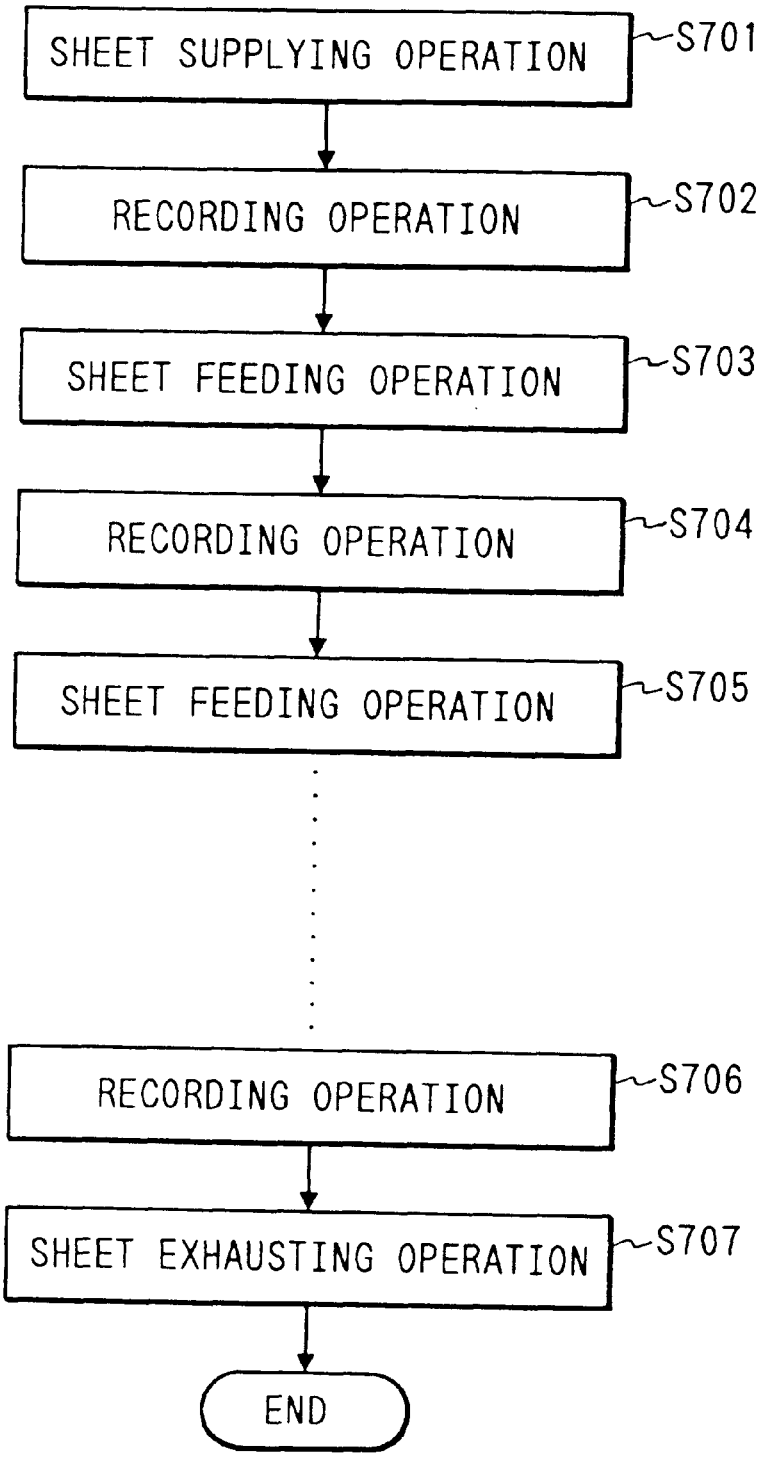
FIG. 20 is a flowchart showing an example of operation sequence of a recording apparatus to which the present invention is applied.

FIG. 20 is a flowchart showing an example of the operation sequence in the recording apparatus. In FIG. 20, if the recording apparatus is activated, the sheet supply operation is performed at step S701 prior to the recording operation (image forming operation). In the sheet supply operation, the recording medium P within a sheet supply cassette is picked up by a sheet supply roller (pick-up roller), not shown, and placed on a conveyance system for conveying the sheet to the recording position. Then, the first recording operation (image forming operation) is entered. In the recording operation b, the first (first line) recording is performed by driving the recording head 1 on the carriage 119 while moving (scanning) the carriage 119 along the guide rail 120 in a direction of the arrow b.

Figure 21:
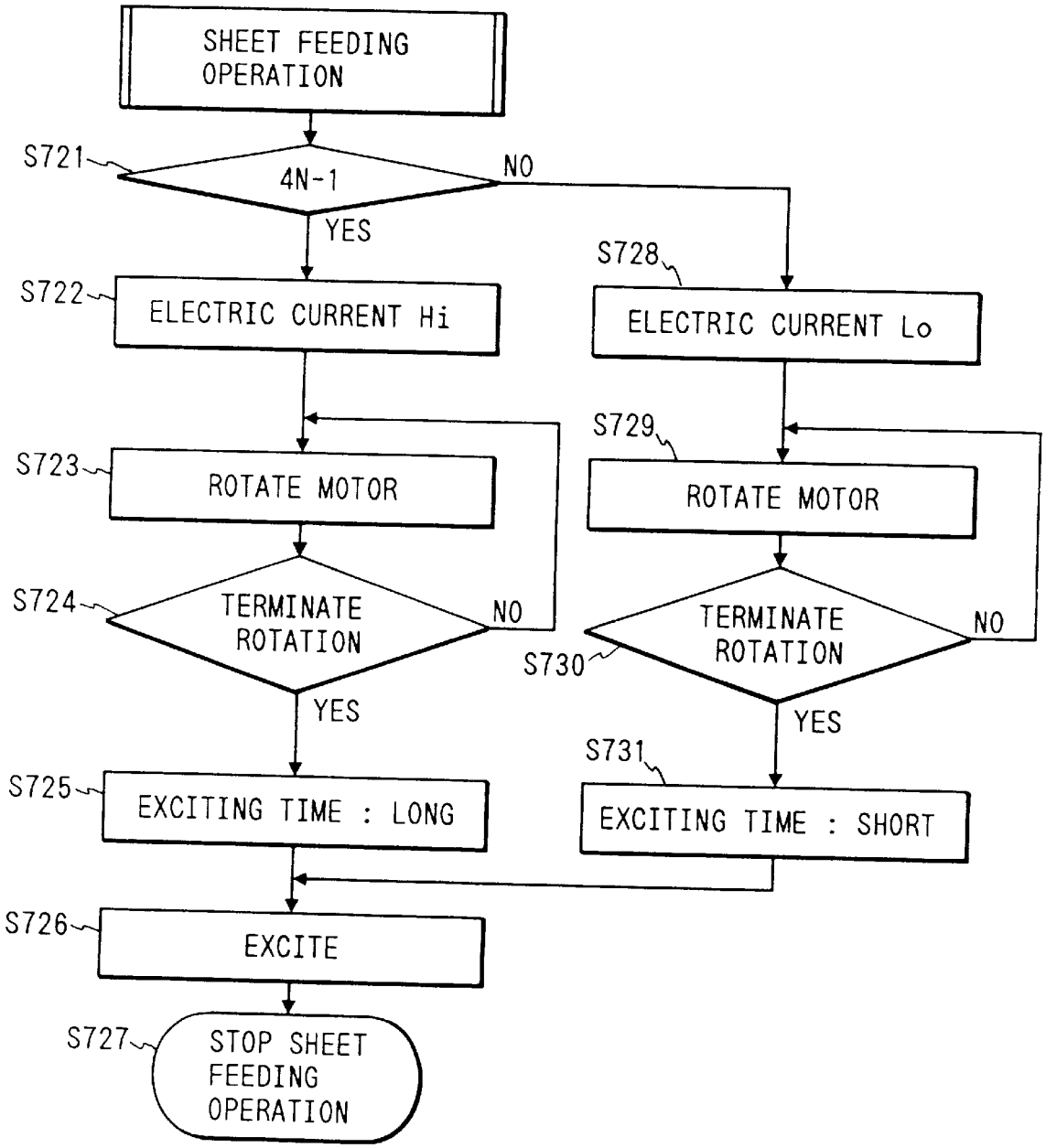
FIG. 21 is a flowchart showing an operation sequence in a subroutine for sheet feeding operation in FIG. 20.

After terminating the first recording operation, the first sheet feeding operation is entered at step S703, FIG. 21 is a flowchart showing an operation sequence of sheet feeding operation (sub-routine) in FIG. 20. Herein, the relation between the operation of conveying roller 109 (FIG. 2) and the position of pressure roller 305 (FIG. 12) in this embodiment will be first described. In this embodiment, the pressure roller 305 is controlled to reside at position I (FIG. 12) immediately after the sheet supply operation (step S701). Thereafter, the pressure roller 305 moves from position I to position II (FIG. 12) upon the first sheet feeding operation, moves from position II to position III (FIG. 12) upon the second sheet feeding operation, moves from position III to position IV (FIG. 12) upon the third sheet feeding operation, and moves from position IV to position I upon the fourth sheet feeding operation, whereby every time the sheet feeding operation is conducted, the pressure roller 305 moves in the same way. That is, the pressure roller 305 returns to the position I upon the fourth sheet feeding operation, and moves from position I to position II upon the next sheet feeding operation.

And in driving the pump 124, an extraordinary great pressure will be exerted against the pressure roller which moves from the state where the pressure roller 305 does not press the tube 123 to the state where it squeezes (compresses) the tube 123, so that the load applied on the drive source of the pump 124 (guide roller 304) becomes large. That is, when the pressure roller 305 moves from position I to position II, the load applied on a motor (drive source) 108 commonly used with the conveyance roller 109 becomes extraordinary large.

Thus, in the sheet feeding operation (sub-routine) of FIG. 21, at step S721, the number of feeding sheet from immediately after the termination of the sheet supply operation is determined—first, fifth, ninth, thirteenth, seventeenth, twenty-first, twenty-fifth, or twenty-ninth. If the answer is true (Y), the procedure proceeds to step S722, while if the answer is false (N), the procedure proceeds to step S728.

First, as the correspondence to one of the above numbers occurred, the operation when proceeding to step S722 will be described below. At step S722, the current for rotating the motor (pulse motor) 108 in feeding sheet is set to Hi which is higher than the normal current (for example, the higher current Hi is set to 0.9A and the normal current Lo is set to 0.45A). The reason thereof will be described below.

As previously described, the pulse motor 108 as the drive source in feeding sheet is used in this embodiment. This motor 108 is also used as the drive source of suction recovery mechanism (pump 124), wherein if either one of the sheet feeding mechanisms 109, 111 and the suction recovery mechanism is driven, the other mechanism is also driven. Accordingly, when feeding sheet during the image formation (recording operation), this phenomenon of entraining also occurs, whereby the conveying motor (pulse motor) 108 is driven to feed sheet, the pump 123 of suction recovery mechanism is also driven.

Hence, if feeding sheet is performed in a state in which the pressure roller 305 resides at position I, the pressure roller 305 moves from position I where the pressure roller 305 does not press against the tube 123 to position II where it compresses (squeezes) the tuber 123, so that the power (load) applied on the motor 108 is increased due to the previous reason. That is, in the conventional arts, if the motor is used in view of the normal load, the motor causes a trouble in operation when the pressure roller 305 moves from position I to position II, whereby there is a risk that the adverse effect may be exerted on the sheet feeding operation.

Thus, in this embodiment, the current for the supply to the conveying motor (pulse motor) 108 is made higher than normal when the pressure roller 305 moves from position I to position II, that is, every four times of sheet feeding operation (when the number of sheet feeding operation from immediately after the termination of sheet supply operation is first, fifth, ninth, thirteenth, seventeenth, twenty-first, twenty-fifth, and twenty-ninth), thereby increasing the torque of the motor 108, so that the sheet feeding operation is controlled not to cause any trouble. Thus, at step S723, the motor 108 is rotated at a higher current Hi than normal, which has been set at step S722.

And at step S724, the termination of motor rotation is judged, wherein if the motor rotation is not terminated, the procedure returns to step S723 to rotate the motor, while if it is terminated, the procedure proceeds to step S725, where the exciting time for stopping the motor 108 against its inertia is set to a longer time (LONG) than normal. Then, at step S726, the motor is excited to stop the motor 108, and at step S727, the sheet feeding operation is ended.

Herein, the reason that the exciting time is set to a longer time (LONG) than normal at step S725 will be described below. When the number of feeding sheet at step S721 corresponds to any of the above-cited numbers (in the case of Y), the pressure roller 305 passes between position I and position II, whereby the current to be supplied to the motor 108 is set to a higher value Hi, so that the torque of the motor 108 is increased. Hence, the inertial force after the termination of rotation of the motor 108 is greater than normal, whereby it is necessary to set the exciting time taken for stopping the motor to a longer time than normal. The longer exciting time (LONG) is set to about 500 msec., for example.

Next, the operation from step S728 in which the number of feeding sheet does not correspond to any of the above-cited numbers at step S721 will be described below. That is, the sheet feeding operation and the exciting time will be described below when the pressure roller 305 moves through each of the regions from position II to position III, from position III to position IV, and from position IV to position I (except for the region from position I to position II). First, at step S728, the current for the supply to the motor 108 is set to a normal value Lo (e.g., 0.45A), and at step S729, the motor 108 is driven at the current Lo.

And at step S730, the termination of motor rotation is judged, wherein if the motor rotation is not terminated, the procedure returns to step S729 to rotate the motor 108, while if it is terminated, the procedure proceeds to step S731, where the exciting time for stopping the motor 108 against its inertia is set to a normal time (SHORT). Then, as previously described, at step S726, the motor is excited to stop the motor 108, and at step S727, the sheet feeding operation is ended. In this case, at step S731, the exciting time for stopping the rotation of the motor 108 against its inertia is set to about 200 msec., for example, because the driving current of the motor 108 is a normal value Lo.

In FIG. 20, after the first sheet feeding operation (sheet feeding operation based on the sub-routine as detailed in FIG. 21) at step S703 is terminated, the second recording operation (image forming operation) is performed at step S704, and the second sheet feeding operation (see FIG. 21) is performed at step S705. Thereafter, the third and fourth recording operations (image forming operations) as well as sheet feeding operations are performed, and after the final (e.g., thirty-third) recording operation is terminated at step S706, the recording medium P is exhausted in the sheet exhausting operation at step S707, whereby the recording operation on the recording medium P is ended.

According to the embodiments as above described, conveying means (conveyance roller 109) for feeding the recording medium P such as a recording sheet, and other activating means such as the pump 224 of suction recovery mechanism, are driven by the same motor (pulse motor) 108, and only at the timing when the resistance of other activating means 124 is larger to increase the load on the motor 108, the power (current) for the supply to the motor 108 is made greater than normal, whereby even when it is apprehended that the sheet feeding operation may be affected adversely by the overload of the motor 108, the power of the motor 108 is temporarily raised, so that it is possible to feed sheet correctly without influence from the other activating means 123. Thereby, even when the drive source of conveying means 109 for the recording medium P and the drive source of other activating means such as the suction recovery means are commonly used, it is possible to feed sheet correctly by eliminating conveyance unevenness of the recording medium P, without making larger the motor as the driving source or bringing about large noise, whereby the degraded recording quality due to the occurrence of image streaks, or the nonconformity due to faulty operation can be prevented.

While in the previous embodiment the current value is controlled to take either of two values corresponding to the region of I to II where the load of the pressure roller 305 is particularly greater and the other regions, it will be appreciated that the current value may be divided into four types for the region of I to II where the pressure roller 305 moves from the non-contact state to the pressing state, the region of II to III where it always presses against the tube 123, the region of III to IV where it moves from the pressing state to the non-contact state, and the region of IV to I where it is always in the non-contact state, or other types (e.g., three types) so that the current value is controlled depending on the divided region. Also, while the power to be varied was the current in the previous embodiment, it will be appreciated that the voltage may be varied.

While in the previous embodiments, a recording apparatus of the serial type in which the recording head cartridge is moved for the recording in a transverse direction to the recording medium P was exemplified, it will be understood that the present invention is also applicable to a recording apparatus of the line type in which a line type recording head of the length corresponding totally or partially to the width of the recording medium is used to perform the recording only by sub-scanning, with the same effects. Also, the present invention is also applicable to an ink jet recording apparatus in whatever form of the recording head, such as the cartridge type in which the recording head is integrated with the ink tank, and a type in which the recording head and the ink tank are separately provided and connected via the ink supply tube, whereby the same effects can be obtained.

Moreover, while in the previous embodiments a recording apparatus using a single recording head cartridge was exemplified, it will be understood that the present invention is also applicable to a color recording apparatus using a plurality of recording heads for recording in different colors, or a gradation recording apparatus using a plurality of recording heads for recording in different densities with the same color, irrespective of the number of recording heads and the used colors.

The present invention is applicable to an ink jet recording apparatus, for example, using recording means (recording head) with electricity-heat converters such as piezo-elements, and brings about excellent effects particularly in the ink jet recording apparatus in the method of discharging the ink with the heat energy among the various ink jet recording systems. With such a method, the higher density and higher definition of recording can be obtained.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals.

By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic. As the driving signals of such pulse shape, those as disclosed in U.S. Pat. NoS. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. Nos. 4,558,333 or 4,459,600 disclosing the constitution having the heat acting portion arranged in the flexed region is also included in the present invention. In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure wave of heat energy corresponding to the discharging portion. That is, the present invention makes it possible to realize the secure and efficient recording, in whatever form the recording head may be configured.

Further, as previously described, the present invention is effectively applicable to a recording head of the full line type having a length corresponding to the maximum width of a recording sheet (recording medium) which can be recorded by the recording device. As such a recording head, either the constitution which satisfies its length by a combination of a plurality of recording heads or the constitution as one recording head integrally formed may be used. In addition, among the serial-type recording heads as above described, the present invention is effective for a recording head fixed to the main device, a recording head of the freely exchangeable tip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific example of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

As for the type of recording head to be mounted or the number of recording heads, the present invention is effective to a single recording head provided corresponding to the monochromatic ink or a plurality of recording heads corresponding to a plurality of inks having different recording colors or densities, for example. That is, as the recording mode of the recording device, the present invention is extremely effective for not only the recording mode only of a primary color such as black, etc., but also a device equipped with at least one of plural different colors or full color by color mixing, whether the recording head may be either integrally constituted or combined in plural number.

In addition, though the ink is considered as the liquid in the embodiments as above described, the ink may be placed in solid state below room temperature as long as it will soften or liquefy at or above room temperature, or liquefy when a recording enable signal is issued as it is common with the ink jet device to control the viscosity of ink to be maintained within a certain range of the stable discharge by adjusting the temperature of ink in a range from 30° C. to 70° C. In addition, in order to avoid the temperature elevation due to heat energy by positively utilizing the heat energy as the energy for the change of state from solid to liquid, or to prevent the evaporation of ink by using the ink which will stiffen in the shelf state, the use of the ink having a property of liquefying only with the application of heat energy, such as liquefying with the application of heat energy in accordance with a recording signal so that liquid ink is discharged, or may be solidifying prior to reaching a recording medium, is also applicable in the present invention.

In such a case, the ink may be held as liquid or solid in recesses or through holes of a porous sheet, which is placed opposed to electricity-heat converters, as described in Japanese Laid-Open Patent Application No. 54-56847 or No. 60-71260. The most effective method for the ink as above described in the present invention is based on the film boiling.

Further, the ink jet recording apparatus according to the present invention may be used as an image output terminal in the information processing equipment such as a computer, a copying machine in combination with a reader, or a facsimile terminal equipment having the transmission and reception feature.

As above described, according to the present invention, there is provided a recording apparatus for recording on a recording medium by the use of recording means, wherein conveying means of the recording medium and other activating means are driven by the same motor, and the supply power to the motor is increased or decreased at a predetermined timing when the other activating means is driven, so that it is possible to feed sheet correctly during the sheet feeding operation, without influence from the other activating means, even if the drive source for the conveying means and the other activating means is commonly used.

According to another embodiment of the present invention, there is provided a recording apparatus wherein in addition to the above constitution, recording means is ink jet recording means for recording by discharging the ink and the other activating means is a pump for sucking the ink through discharge orifices of the recording means, or the pump is a tube pump for pressing the tube with a pressure roller and the power supply to the motor is increased when the pressure roller compresses the tube, so that it is possible to feed sheet correctly during the sheet feeding operation, without being affected by the driving of the suction recovery operation, even if the conveying means of the recording medium and the suction recovery mechanism are driven by a common motor.

What is claimed is:

1. An apparatus provided with a carriage for removably mounting a head member, said apparatus comprising:

power transmitting means for supplying electric power for driving the head member to the head member;

head protecting means which is releasable so that the head member is removable from said carriage;

detecting means for detecting a release of said head protecting means; and shut-off means for shutting off power transmission to the head member by said power transmitting means in accordance with detection by said detecting means of the release of said head protecting means, said shut-off means shutting off the electric power for driving the head member, and shutting off the electric power for communication between the head member and said apparatus or for controlling the head member.

2. An apparatus according to claim 1, wherein the head member is a recording head for recording an image to a recording medium.

3. An apparatus according to claim 2, wherein the recording head is an ink jet recording head for discharging an ink from an ink discharge port.

4. An apparatus according to claim 3, wherein the ink jet recording head discharges the ink using thermal energy generated by an electrothermal converting means.

5. An apparatus according to claim 1, wherein said head protecting means is a cover provided on said apparatus to cover the head member.

6. A recording apparatus for removably mounting a head member, said apparatus comprising:

power transmitting means for supplying electric power for driving the head member to the head member;

head protecting means which is releasable so that the head member is removable from said recording apparatus;

detecting means for detecting a release of said head protecting means; and shut-off means for shutting off power transmission to the head member by said power transmitting means in accordance with detection by said detecting means of the release of said head protecting means, said shut-off means shutting off the electric power for driving the head member, and shutting off the electric power for communication between the head member and said apparatus or for controlling the head member.

7. An apparatus according to claim 6, wherein the head member is an ink jet recording head for discharging an ink from an ink discharge port.

8. An apparatus according to claim 7, wherein the ink jet recording head discharges the ink using thermal energy generated by an electrothermal converting means.

9. An apparatus according to claim 6, wherein said head protecting means is a cover provided on said apparatus to cover the head member.

* * * * *